US008349232B2

(12) United States Patent
Pourdeyhimi et al.

(10) Patent No.: US 8,349,232 B2
(45) Date of Patent: Jan. 8, 2013

(54) MICRO AND NANOFIBER NONWOVEN SPUNBONDED FABRIC

(75) Inventors: Behnam Pourdeyhimi, Cary, NC (US); Nataliya V. Fedorova, Raleigh, NC (US); Stephen R. Sharp, Releigh, NC (US)

(73) Assignee: North Carolina State University, Raleigh, NC (US)

( * ) Notice: Subject to any disclaimer, the term of this patent is extended or adjusted under 35 U.S.C. 154(b) by 1686 days.

(21) Appl. No.: 11/692,692

(22) Filed: Mar. 28, 2007

(65) Prior Publication Data

US 2011/0318986 A1 Dec. 29, 2011

Related U.S. Application Data

(60) Provisional application No. 60/786,545, filed on Mar. 28, 2006.

(51) Int. Cl.

| | |
|---|---|
| ***D01D 5/36*** | (2006.01) |
| ***D01F 8/04*** | (2006.01) |
| ***D04H 3/08*** | (2006.01) |
| ***D04H 3/10*** | (2012.01) |

(52) U.S. Cl. ..... 264/103; 28/103; 28/104; 28/107; 264/172.13; 264/172.17; 264/172.18; 264/211.12; 264/211.16; 264/211.19

(58) Field of Classification Search ..... 264/103, 264/172.13, 172.17, 172.18, 211.12, 211.16, 264/211.19; 156/167, 180, 181; 28/103, 28/104, 107

See application file for complete search history.

(56) References Cited

U.S. PATENT DOCUMENTS

| | | | | |
|---|---|---|---|---|
| 4,127,696 | A | 11/1978 | Okamoto | |
| 5,252,158 | A | 10/1993 | Shimizu et al. | |
| 5,503,899 | A | 4/1996 | Ashida et al. | |
| 5,899,785 | A | 5/1999 | Groten et al. | |
| 6,114,017 | A | 9/2000 | Fabbricante et al. | |
| 2001/0050196 | A1 * | 12/2001 | Okada et al. | 181/175 |
| 2003/0054718 | A1 * | 3/2003 | Ochi et al. | 442/182 |
| 2004/0045145 | A1 | 3/2004 | Wang et al. | |
| 2004/0126579 | A1 * | 7/2004 | Creagan | 428/373 |
| 2005/0032450 | A1 * | 2/2005 | Haggard et al. | 442/327 |
| 2006/0223405 | A1 | 10/2006 | Pourdeyhimi et al. | |

FOREIGN PATENT DOCUMENTS

| | | | |
|---|---|---|---|
| EP | 1 054 096 | A1 | 11/2000 |
| WO | WO 2007/002387 | A2 | 1/2007 |

OTHER PUBLICATIONS

Baker "*Bicomponent Fibers: A Personal Perspective*," Inter Fiber Journal, 1998, pp. 26-42.

Bhat et al., "*Extruded Continuous Filament Nonwovens: Advances in Scientific Aspects*," Journal of Applied Polymer Science, 2002, pp. 572-585, vol. 83.

(Continued)

*Primary Examiner* — Leo B Tentoni
(74) *Attorney, Agent, or Firm* — Alston & Bird LLP

(57) ABSTRACT

The invention provides methods for the preparation of nonwoven spunbonded fabrics and various materials prepared using such spunbonded fabrics. The method generally comprises extruding multicomponent fibers having an islands in the sea configuration such that upon removal of the sea component, the island components remain as micro- and nanofibers. The method further comprises mechanically entangling the multicomponent fibers to provide a nonwoven spunbonded fabric exhibiting superior strength and durability without the need for thermal bonding.

25 Claims, 16 Drawing Sheets

OTHER PUBLICATIONS

Bhat et al., "*Thermal Bonding of Polypropylene Nonwovens: Effect of Bonding Variables on the Structure and Properties of the Fabrics*," Journal of Applied Polymer Science, 2004, pp. 3593-3600, vol. 92.

Bresee et al., "*Fiber Formation During Melt Blowing*" Inter Nonwovens J., 2003, pp. 21-28, vol. 12.

Bresee et al., "*Influence of Processing Conditions on Melt Blown Web Structure: Part 2—Primary Airflow Rate*," Inter Nonwovens J., 2005, pp. 11-18, vol. 14.

Cheng "*This Artificial Leather Beats the Hide off the Real Thing*," Inter Fiber Journal, 1998, pp. 40-41, vol. 13.

Cho et al., "*Fine Structure and Physical Properties of Polyethylene/Poly(ethylene terephthalate) Bicomponent Fibers in High-Speed Spinnin. I. Polyethylene Sheath/Poly (ethylene terephthalate) Core Fibers*," Journal of Applied Polymer Science, 2000, pp. 2254-2266, vol. 77.

Choi et al., "*Effects of interface on the Dynamic Mechanical Properties of PET/Nylon 6 Bicomponent Fibers*," Journal of Applied Polymer Science, 1999, pp. 2083-2093, vol. 74.

El-Salmawy et al., "*Preparing a Core-Sheath Bicomponent Fiber of Poly(butylene Terephthalate)/Poly(butylene Succinate-co-L-lactate)*," Textile Res. J., 2000, pp. 1011-1018, vol. 70, No. 11.

Grafe et al., "*Nanofibers in Filtration Applications in Transportation*," Filtration International Conference and Exposition of the INDA, 2001, Chicago, IL.

Grafe et al., "*Polymeric Nanofibers and Nanofiber Webs: A New Class of Nonwovens*," Inter Nonwovens J., 2003, pp. 51-55, vol. 12.

Graham et al., "*Incorporation of Electrospun Nanofibers Into Functional Structures*", Inter Nonwovens J., 2004, pp. 21-27, vol. 13.

Kessick et al., "*Microscale Electrospinning of Polymer Nanofiber Interconnections*," Applied Physics Letters, 2003, pp. 557-559, vol. 83, No. 3.

Kikutani et al., "*High-Speed Melt Spinning of Bicomponent Fibers: Mechanism of Fiber Structure Development in Poly(ethylene terephthalate)/Polypropylene Stystem*" Journal of Applied Polymer Science, 1996, pp. 1913-1924, vol. 62.

Li et al., "*Electrospinning of Nanofibers: Reinventing the Wheel?*" Advanced Materials, 2004, pp. 1151-1170, vol. 16, No. 4.

MacDiarmid et al., "*Electrostatically-Generated Nanofibers of Electronic Polymers*," Synthetic Metals, 2001, pp. 27-30.

McCann et al., "*Electrospinning of Nanofibers With Core-Sheath, Hollow, or Porous Structures*" Journal of Materials Chemistry, 2005, pp. 735-738, vol. 15.

Reneker et al., "*Nanometre Diameter Fibres of Polymer, Produced by Electrospinning*," Nanotechnology, 1996, pp. 216-223, vol. 7.

Rwei et al., "*PBT/PET Conjugated Fibers: Melt Spinning, Fiber Properties, and Thermal Bonding*," Polymer Engineering and Science, 2004, pp. 331-344, vol. 44.

Subbiah, et al., "*Electrospinning of Nanofibers*," Journal of Applied Polymer Science, 2005, pp. 557-569, vol. 96.

Sun, et al., "*Compound Core-Shell Polymer Nanofibers by co-Electrospinning*, " Advanced Materials, 2003, pp. 1929-1932, vol. 15, No. 22.

Yamada, et al., "*Relationship Between Orientation of Amorphous Chains and Modulus in Highly Oriented Polypropylene*," Journal of Applied Polymer Science, 1981, pp. 49-60, vol. 26.

Yoshimura et al. "*Structure Formation of Blend and Sheath/Core Conjugated Fibers in High-Speed Spinning of PET, Including a Small Amount of PMMA*," Journal of Macromolecular Science, 2003, pp. 325-339, vol. B42, No. 2.

Zhang et al., "*An Investigation of Fiber Splitting of Bicomponent Melblown/Microfiber Nonwovens by Water Treatment*," Journal of Applied Polymer Science, 2004, pp. 1218-1226, vol. 94.

Zhao et al., "*Attenuating PP/PET Bicomponent Melt Blown Microfibers*," Polymer Engineering and Science, 2003, pp. 463-469, vol. 43, No. 2.

Zhao, et al., "*Properties of PP/PET Bicomponent Melt Blown Microfiber Nonwovens After Heat-Treatment*, " Polymer International, 2003, pp. 133-137, vol. 52.

* cited by examiner

MICRO AND NANOFIBER NONWOVEN SPUNBONDED FABRIC

CROSS-REFERENCE TO RELATED APPLICATIONS

This application claims the benefit of U.S. Provisional Application No. 60/786,545, filed Mar. 28, 2006, which is incorporated herein in its entirety.

FIELD OF THE INVENTION

The invention relates to micro- and nanofibers and fabrics prepared from such fibers. More particularly, the invention relates to nonwoven spunbonded fabrics prepared using micro- and nanofibers.

BACKGROUND

There is an ongoing search in the textiles field for high strength nonwoven materials. In particular, there is a growing need in the art for nonwoven materials comprising microfibers and/or nanofibers.

Fabrics composed of micro- or nanofibers offer small pore size and large surface area. Thus, they generally bring value to applications where such properties as sound and temperature insulation, fluid holding capacity, softness, durability, luster, barrier property enhancement, and filtration performance are needed. In particular, products intended for liquid and aerosol filtration, composite materials for protective gear and clothing, and high performance wipes could benefit greatly from the introduction of such small fibers.

Manufacturing techniques associated with the production of polymeric micro- and nanofibers are electrospinning, meltblowing, and the use of multicomponent fibers, such as segmented pie and islands-in-the-sea (I/S) fibers. In electrospinning, a fiber is drawn from a polymer solution or melt by electrostatic forces. This process is able to produce filaments with diameters in the range from 40 to 2000 nm. Meltblowing processes are capable of producing fibers having diameters of 0.5 μm to 10 μm. Even though filaments measuring 0.5 μm can be obtained via this technique, most commercially available meltblown media are generally about 2 microns and above.

In general, meltblowing and electrospinning produce nonwoven mats rather than single fibers and these mats consist of fibers characterized by low strength. Thus, electrospun or meltblown fiber webs are typically laid over a suitable substrate that provides appropriate mechanical properties and complementary functionality to the fabric. Moreover, existing meltblowing processes are not able to produce nanofiber webs easily, and they can process only a limited number of polymers. Electrospinning, on the other hand, is able to make nanofiber mats with substantially smaller fibers than meltblown or spunbonded webs; however, this process has very low productivity.

With multicomponent fibers, the I/S approach can produce significantly smaller fibers than the segmented pie technique, however the sea in the I/S fibers has to be removed, and this often creates an environmental issue. Also, since virtually all spunbonds are thermally bonded, subsequent removal of the sea component from thermally bonded substrates generally results in the loss of structure as a result of disintegration of the bond spots. In other words, the art has heretofore failed to provide methods for producing I/S spunbond webs that provide high strength and retain integrity after removal of the sea component. Thus, I/S spunbond webs require an alternative means of bonding the structure in place of thermal bonding.

Because of the above mentioned shortcomings, there are no commercial products available today based on the spunbond I/S technology. The present invention fills such void in the market for the production of large volumes of micro- and nanofiber webs.

SUMMARY OF THE INVENTION

The present invention provides nonwoven, spunbonded fabrics prepared using micro- and nanofibers. Such fabrics exhibit high strength and durability while maintaining a relatively low basis weight (i.e., weight per unit area of fabric). Moreover, the fabrics prepared according to the invention further exhibit improved mechanical properties, such as tensile strength and tear strength. Surprisingly, all of these advances are achieved without the necessity of thermal bonding, as is normally associated with spunbonded fabrics.

In one aspect, the invention is directed to a method of preparing a nonwoven spunbonded fabric. The fabric can be of varying dimensions and varying web weights while still maintaining the valuable properties described herein. In one embodiment, the method of the invention comprises extruding continuous multicomponent fibers, forming a spunbonded web, and mechanically entangling the multicomponent fibers in the web to form a nonwoven spunbonded fabric. The multicomponent fibers preferably have a predetermined average diameter and are extruded to have an islands in the sea configuration. Generally, the I/S multicomponent fibers comprise a plurality of island components surrounded by a sea component. In specific embodiments, the island components comprise a first polymer and the sea component comprises a second polymer. The first polymer and the second polymer can comprise the same or different polymer. Moreover, the first and second polymers can each comprise a single polymer or can comprise mixtures of polymers, including homopolymers, copolymers, and terpolymers.

The method of the invention can comprise process steps generally associated with spunbonding. For example, the extruding step can comprise one or more of the following steps: spinning the multicomponent fiber through a die; quenching the spun fibers, such as with forced air; attenuating a plurality of extruded fibers; laying (such as in a random manner) the extruded fibers onto a surface, particularly a moving surface, such as a forming belt, to form a nonwoven material; moving the nonwoven material through one or more compaction rollers; and winding the nonwoven material onto a roll, such as a winder.

The method of the invention can also include further process steps. In one embodiment, the method further comprises thermally bonding the multicomponent fibers. For example, the multicomponent fibers can be extruded and laid on a forming belt and then moved through a calendaring device, or any other type of device useful for providing heat generally or at discrete points across a surface of the nonwoven material sufficient to at least partially melt a portion of the nonwoven material and thus thermally bond the nonwoven web at one or more points.

In further embodiments, the method can also comprise removing the sea component of the multicomponent fiber. For example, the fibers can be subjected to a water and/or chemical treatment using reagents capable of dissolving or otherwise breaking down the material used in making the sea component. Preferably, the treatment used to remove the sea component does not adversely affect the island components, which should be left substantially intact after removal of the sea component. Still further, the method of the invention can comprise subjecting the spunbonded fabric to certain processing steps after removal of the sea component. For example, the method can comprise thermally bonding at least a portion of the island components. Such thermal bonding can comprise any useful method, including methods used for thermal bonding of a multicomponent fiber prior to removal of the sea component, such as calendaring The method of the invention is particularly useful in that it provides for preparation of the multicomponent fiber according to certain specifications such that desired fiber size can be achieved while maximizing mechanical properties of the fibers. For example, in certain embodiments, the multicomponent fiber can be described as comprising an outer surface, which is generally formed of the sea component of the multicomponent fiber. Preferentially, the sea component completely surrounds island components such that none of the island components form any portion of the outer surface of the fibers. In other words, none of the island components protrude through the sea component to be in physical connection with the ambient environment outside the fiber.

In specific embodiments, the sea component completely surrounds the island components such that the sea component forms a sheath around the island components. The sheath can be described as having a measurable thickness between the outer surface of the multicomponent fiber and the islands nearest the outer surface of the multicomponent fiber. For example, the island components can be arranged inside the sea in concentric circles or rings. As such, the most outer ring would comprise the islands nearest the outer surface of the overall fiber, and the sea component would be present to form a sheath exterior to the outer ring of islands. In such embodiments, the sea component can also be present around and between the multiple island components within the multicomponent fiber. Preferably, the sheath formed around the outer circumference of the multicomponent fiber has a thickness that is greater than or equal to an average diameter of the island components. For example, in embodiments wherein the island components have an average diameter of 200 nm, the sheath formed by the sea component preferably has a thickness of at least about 200 nm, and in embodiments wherein the island components have an average diameter of 800 nm, the sheath preferably has a thickness of at least about 800 nm.

In various embodiments of the invention, the island components of the multicomponent fiber can be prepared to have a variety of diameters. Preferably, the multicomponent fibers are prepared such that all of the islands within a given fiber have a substantially uniform diameter. Of course, the invention also encompasses embodiments wherein islands within the same fiber have different diameters. Generally, the multicomponent fibers of the invention can be prepared to comprise islands having an average diameter in the range of about 50 nm to about 5 μm. In preferred embodiments, the islands have an average diameter in the range of about 100 nm to about 800 nm.

The average diameter of the island components within the multicomponent fiber can depend upon the overall diameter of the multicomponent fiber as well as the number of island components present within a given multicomponent fiber. Generally, increasing the number of islands within the multicomponent fiber naturally reduces the average diameter of the islands within the fiber given a fixed cross-sectional area for containing the islands. Although as few as two islands can be prepared, the method of the invention allows for preparation of multicomponent fibers comprising a relatively large number of islands. In preferred embodiments, the multicomponent fiber comprises between about 36 and about 400 island components. However, an even greater number of islands can be prepared according to the invention, such as up about 1000 islands within a given multicomponent fiber.

The method of the invention is particularly characterized in that it allows for the preparation of a nonwoven spunbonded fabric using I/S multicomponent fibers without the need for thermal bonding. This avoids the reduction in web integrity that typically accompanies removal of the sea component. This is achieved according to the present invention through use of mechanical entangling methods. Specifically, after the extruded fiber is laid on a surface to form a nonwoven web, the nonwoven web is subjected to mechanical entangling means to interconnect the multiple multicomponent fibers present. Thus, the entangled, nonwoven web is provided with physical integrity and strength from the multiple cross-over points within the entangled web. Moreover, when the sea component is later removed, the various micro- and nanofibers left behind (i.e., the island components of the multicomponent fiber) remain entangled and form a nonwoven, spunbonded fabric prepared without the need for thermal bonding. Various methods can be used according to the invention to mechanically entangle the fibers. For example, the step of mechanically entangling the multicomponent fibers can comprise a method selected from the group consisting of hydroentangling, needle punching, steam jet entangling, and combinations thereof.

The multicomponent fiber of the invention can be prepared using various polymers for the island components and the sea component. Preferably, the polymer used for the island components is different from the polymer used for the sea component. In a preferred embodiment, the island components comprise a polyamide polymer, such as nylon, and the sea component comprises a polymer such as poly(lactic) acid (PLA).

In further aspects, the present invention provides a variety of products prepared according to the method of the invention. For example, in one embodiment, the invention provides a nonwoven spunbonded fabric prepared according to the method described herein. Such fabrics in turn find use in a variety of fields, such as filter products and barrier textiles.

DETAILED DESCRIPTION OF THE INVENTION

Figure 1:
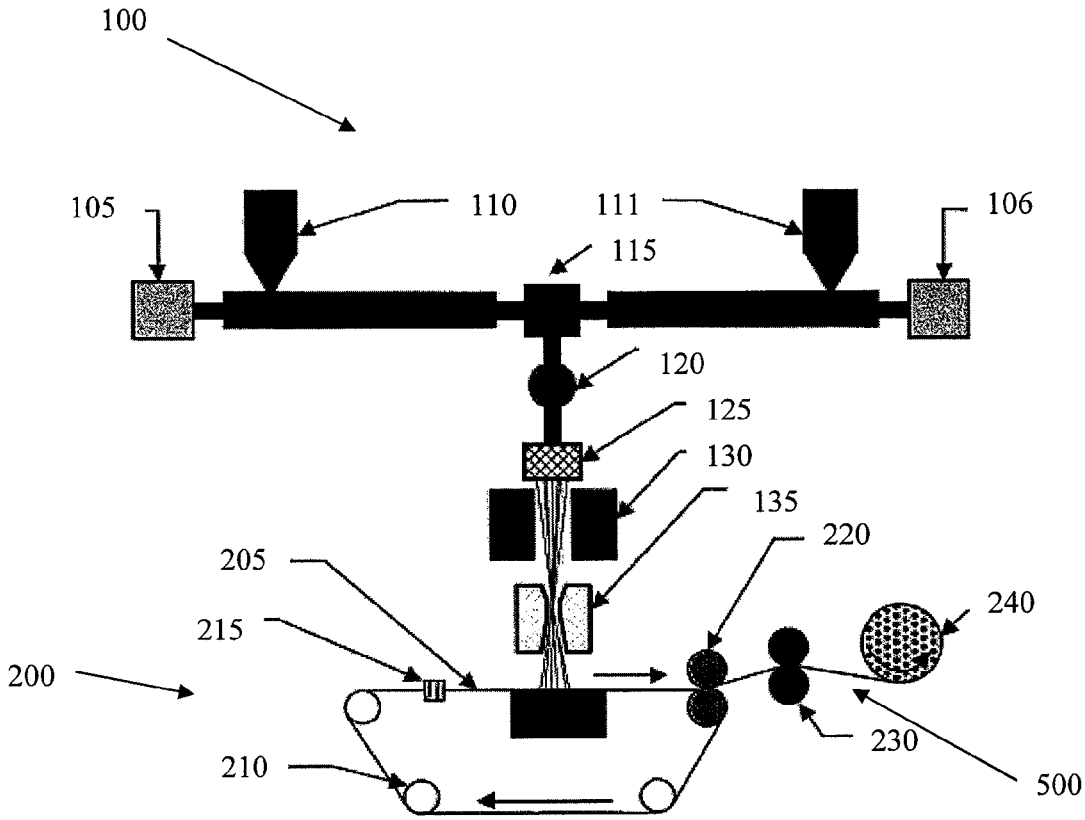
FIG. 1 is an illustration of an apparatus for preparation of a spunbonded material useful according to one embodiment of the invention.

The present inventions now will be described more fully hereinafter with reference to specific embodiments of the invention and particularly to the various drawings provided herewith. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The invention comprises high strength micro- and nanofiber nonwoven webs prepared in a spunbond process. The nonwoven, spunbonded webs are prepared from multicomponent fibers, such as islands in the sea (I/S) fibers. The materials prepared according to the invention can be customized to have defined characteristics through varying the types of polymers used in preparing the fibers, varying the number and average diameter of the islands present in the multicomponent fibers, and varying other production parameters that can affect fiber mechanical properties.

In the fiber industry, there is no commonly accepted definition of nanofibers. Some authors refer to them as materials with a diameter ranging from 0.1 to 0.5 μm (100-500 nm), while others consider filaments smaller than 1 μm (1000 nm) to be nanofibers. Still others describe nanofibers as fibers with diameters below 0.1 μm (e.g., 100 nm). As used herein, the term "nanofibers" refers to a fiber having an average diameter of about 500 nm or less. The term "microfiber", as used herein, refers to a fiber having an average diameter ranging from about 0.5 μm to about 5 μm. Thus, collectively, the phrase "micro- and nanofibers" refers to fibers generally having diameters of about 5 μm or less, and "micro- and nanofibers" can indicate microfibers, nanofibers, or a combination of microfibers and nanofibers.

The present invention is characterized by the ability to easily and reliably prepare nonwoven spunbonded materials comprising micro- and nanofibers. Such materials provide benefit in a variety of arenas arising from useful properties of the microfibers and nanofibers, such as relatively large surface area, small pore size, flexibility, and lightness. The nonwoven, spunbonded materials of the invention prepared using micro- and nanofibers find use in numerous applications, such as liquid and air filters, barrier fabrics (e.g., medical gowns and facemasks), tissue engineering, technical and personal care wipes, and artificial leather products.

There are methods known in the art for preparing microfibers and nanofibers; however, such known methods suffer from many drawbacks and are not useful for preparing spunbonded materials as described herein. For example, electrospinning allows for preparation of nanofibers by drawing a fiber from a polymer solution using electrostatic forces. Electrospinning is disadvantageous, though, because it is difficult to prepare a single, continuous fiber by this method (rather nonwoven webs are generally unavoidable). Moreover, it is difficult to control fiber diameter and molecular orientation, the spun webs exhibit poor mechanical properties, the method is generally limited to the use of low viscosity polymers, vapor production raises environmental issues, proper procedures must be followed to avoid fiber inhalations, and electrospinning is typically plagued by low productivity.

The present invention overcomes these problems by providing methods of preparing spunbonded fabrics comprising multicomponent fibers. Accordingly, in one embodiment, the method of the invention comprises extruding continuous filament multicomponent fibers and mechanically entangling the multicomponent fibers to form a nonwoven spunbonded fabric. The multicomponent fibers preferably have a predetermined average diameter and have an islands in the sea configuration comprising a plurality of island components comprising a first polymer surrounded by a sea component comprising a second polymer.

A typical apparatus for preparation of a spunbonded material using multicomponent fibers is illustrated in FIG. 1, wherein an extruder apparatus 100 and a web-forming apparatus 200 are generally shown. Any apparatus useful for extruding polymeric materials into fibers, particularly multicomponent fibers, could be used as an extruder apparatus according to the inventive method, which is not limited to the specific embodiment illustrated in FIG. 1. Likewise, any apparatus useful for collecting extruded fibers to form a web, particularly a nonwoven web, could be used as a web-forming apparatus according to the inventive method, which is not limited to the specific embodiment illustrated in FIG. 1.

As seen in FIG. 1, the extruder apparatus 100 is set up for forming a bicomponent fiber from a first polymer and a second polymer and thus comprises first and second extruder drives 105, 106 and first and second polymer hoppers 110, 111, which feed the polymers through a filter 115 and into a melt pump 120. The polymers move through a spinneret 125 which preferably includes a die (not shown) for forming a desired number of multicomponent fibers having the appropriate multicomponent structure. Extrusion processes and equipment, including spinnerets, for making multicomponent continuous filament fibers are well known and need not be described here in detail. Generally, a spinneret includes a housing containing a spin pack which includes a plurality of plates stacked one on top of the other with a pattern of openings arranged to create flow paths for directing fiber-forming components separately through the spinneret. The spinneret has openings or holes arranged in specified patterns. The polymers are combined in a spinneret hole. The spinneret is configured so that the extrudant has the desired overall fiber cross section (e.g., round, trilobal, etc.). The spinneret openings form a downwardly extending curtain of filaments. Such a process and apparatus is described, for example, in U.S. Pat. No. 5,162,074, to Hills, which is incorporated herein by reference.

Following extrusion through the die, the resulting thin fluid strands, or filaments, remain molten for some distance before they are solidified by cooling in a surrounding fluid medium, which may be chilled air blown through the strands. As illustrated in FIG. 1, the extruded fibers are solidified using an air quencher 130. The quenched fibers are gathered and oriented using an air attenuator 135 following extrusion through the die and then directed onto the web-forming apparatus 200.

The web-forming apparatus 200 typically comprises a take-up surface, such as a roller or a moving belt. In FIG. 1, the take-up surface comprises a forming belt 205, which can be perforated. The forming belt moves around a series of guide rollers 210 in the direction of the arrows shown parallel to the belt. The web-forming apparatus further comprises an edge guide 215 to maintain the forming belt 205 on the guide rollers 210 and assist with formation of a uniform web. In this way, a spunbond web is formed on the belt. Such forming can also include the use of forced air to direct the fibers onto the belt.

FIG. 1 further illustrates an optional compaction roller 220, which can be used to compress the formed web. A calendar 230 is also illustrated and can be optionally present to thermally bond the nonwoven web. In known spunbonding methods, the use of a calendaring device is necessary to ensure the strength and integrity of the spunbonded material by thermally bonding multiple portions of the nonwoven fibers; however, the present invention makes the use of such thermal bonding equipment solely optional. The formed nonwoven spunbonded material 500 can be rolled onto a winder 240 to collect the finished material. Other process steps not illustrated in FIG. 1 can also be included according to the invention. For example, prior to moving onto the winder 240, the spunbonded material 500 can be directed through an appropriate apparatus for mechanically binding the spunbonded material 500, as further described below. In this manner, the present invention allows for the use of continuous filaments to form a nonwoven, spunbonded material, which is favorable because it provides for good fiber orientation and crystallinity, high strength, and low fiber diameter variability.

Figure 2:
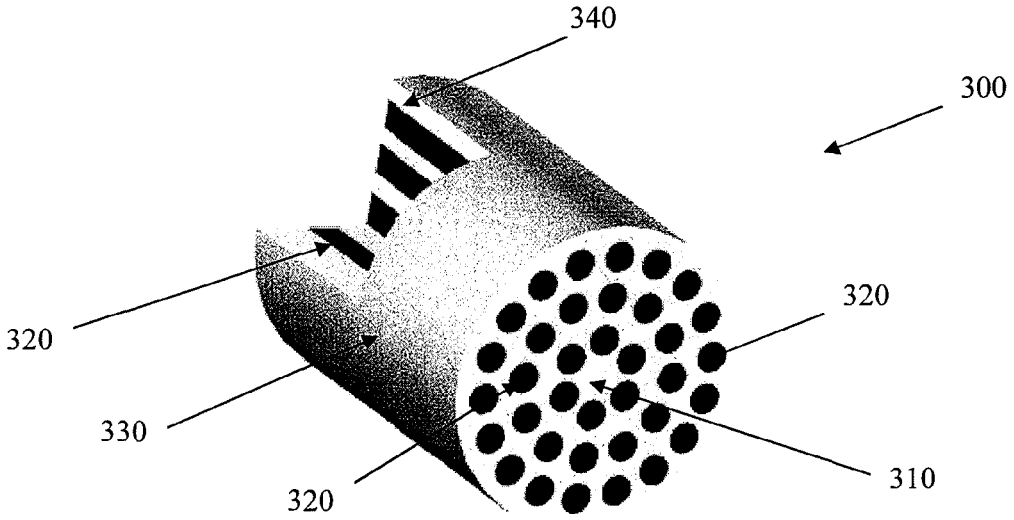
FIG. 2 is a top perspective view of an islands in the sea multicomponent fiber according to one embodiment of the invention showing a cross-section of the multicomponent fiber as well as a cut-out section of the fiber.

As previously pointed out, the multicomponent fibers of the present invention preferably have an islands in the sea (I/S) configuration. One embodiment of an I/S multicomponent fiber useful according to the invention is shown in FIG. 2. Only a segment of the multicomponent fiber is shown in FIG. 2, but the fiber illustrates both a cross-section of the multicomponent fibers as well as a cut-out section of the fiber. The fiber 300 comprises a sea component 310 and a plurality of island components 320 surrounded by the sea component 310. The fiber 300 also comprises an outer surface 330 that generally comprises the sea-forming polymer.

In cross-section, the I/S fiber can be seen to have a discrete diameter. The method of the invention is particularly beneficial in that nonwoven materials can be prepared using fibers having diameters that are substantially continuous along the length of the multicomponent fiber. The diameter of the multicomponent fiber is further important, as more fully discussed below, because most known methods of preparing nonwoven materials are limited by the overall diameter of the fiber used. For example, in using segmented fibers, the average size of the segments is at least partially limited by the diameter of the multicomponent fiber. In the present invention, however, it is possible to maintain a uniform multicomponent fiber diameter and reduce the average diameter of the fibers ultimately used to prepare the nonwoven material by increasing the number of islands present in the multicomponent fiber.

Preferably, the multicomponent fiber prepared according to the inventive method has an average diameter in the range of about 5 μm to about 25 μm. In further embodiments, the multicomponent fiber is extruded to have an average diameter in the range of about 5 μm to about 20 μm, about 5 μm to about 15 μm, about 10 μm to about 20 μm, or about 10 μm to about 15 μm. The present invention also encompasses multicomponent fibers having smaller overall diameters, and the invention is only limited by the capacity of the overall extrusion process. For example, it is possible to prepare multicomponent fibers having an overall diameter of less than 5 μm and still incorporate a plurality of island components within a sea component according to the present invention.

The method of the present invention is preferably not limited to a specific type of polymer used in preparing the sea component or the island components. Rather, various types of polymer can be used for either component according to the invention. It is possible to use the same type of polymer for both the sea component and the island components. For example, the same polymer type could be used for both components, but certain properties of the polymers be varied, such as molecular weight. Likewise, one component could comprise substantially a first polymer and the other component could comprise a copolymer or terpolymer comprising the first polymer and one or more further polymers.

In preferred embodiments, the polymer used in preparing the sea component is different from the polymer used in preparing the island components. This allows for easy removal of the sea polymer without disturbing the island components or disturbing the integrity of the island components. For example, it is useful for the sea component to comprise a polymer that is easily removable, such as by washing or chemical treatment. Accordingly, it is useful for the island components to comprise a polymer that is substantially resistant to the treatment used to remove the sea component. Preferentially, the sea component comprises a polymer that is water soluble or water dispersible. In further embodiments, the sea polymer can be recyclable or biodegradable.

The polymer used in preparing the sea component can be referred to as the "fugitive" polymer component and can comprise any polymer capable of being removed by washing or other treatment. Preferably, the sea forming polymer comprises a synthetic melt-processable polymer substantially soluble in a benign solvent, such as water, an aqueous caustic solution, or a non-halogenated organic solvent. Non-limiting examples of polymers capable of being dissolved in water include sulfonated polyesters (e.g., sulfonated polyethylene terephthalate), sulfonated polystyrene, and copolymers or polymer blends containing such polymers (e.g., Eastman AQ 55S), ethylene vinyl alcohol (EVOH), polyvinyl alcohol (PVOH), polyethylene oxide, and copolymers or polymer blends containing such polymers. Non-limiting examples of polymers that are substantially soluble in aqueous caustic solution include polyglycolic acid (PGA), poly(lactic) acid (PLA), polycaprolactone (PCL), and copolymers or blends thereof. The term "poly(lactic) acid" is intended to encompass polymers that are prepared by the polymerization of either lactic acid or lactide. Reference is made to U.S. Pat. Nos. 5,698,322; 5,142,023; 5,760,144; 5,593,778; 5,807,973; and 5,010,145, the entire disclosure of each of which is hereby incorporated by reference. Other examples of polymers useful as the sea component include copolymers of polyethylene terephthalate (PET), which are referred to as "co-PET", that are soluble in aqueous media, such as. An example of a polymer that is substantially soluble in one or more non-halogenated organic solvents, such as hexane or xylene, is polystyrene.

Generally, any type of polymer recognized as capable of extrusion can be used according to the invention. For example, any polymer capable of forming a multicomponent fiber (e.g., a polymer capable of forming island components or a polymer capable of forming a sea component) can be used according to the invention. Preferably, if the nonwoven spunbonded material being prepared is intended for use in a specific environment requiring certain polymer properties, the island components can comprise a polymer providing the desired properties. In preferred embodiments, polymers useful in preparing the island components according to the invention include polyolefins (e.g., polyethylene and polypropylene), polyamides (e.g., nylon and nylon-6), polyesters (e.g., polyethylene terephthalate (PET) and polybutylene terephthalate (PBT)), thermoplastics (e.g., thermoplastic polyurethane (TPU)), and the like.

Figure 3:
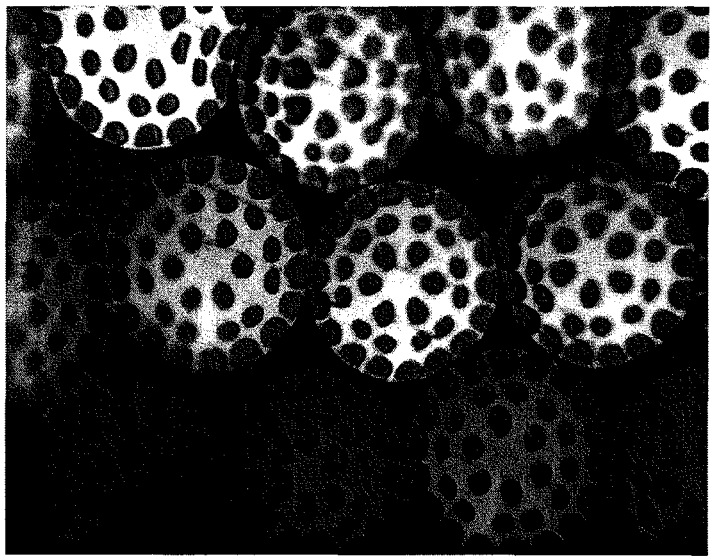
FIG. 3 is a scanning electron micrograph (SEM) image of an I/S multicomponent fiber prepared according to known techniques wherein island components form a portion of the outer surface of the multicomponent fiber.

The method of the invention is particularly useful in the preparation of materials having superior properties because of the specific spinpack design used in extruding the multicomponent fibers. In known methods of preparing I/S fibers it is common for a portion of the island components to not be completely surrounded by the sea component (i.e., portions of the island components protrude through the sea and are in direct contact with the ambient environment). FIG. 3 provides a scanning electron micrograph (SEM) image of an I/S multicomponent fiber prepared according to known techniques. As seen therein, the island components are formed in a distinct pattern within the sea component, and the outermost island components are in physical connection with, and form part of, the outer surface of the multicomponent fiber. The present invention, however, specifically avoids such a design.

As seen in FIG. 2, the multicomponent fiber of the present invention is prepared to comprise an outer surface 330 that is formed of the sea forming polymer. Moreover, the sea component 310 completely surrounds the island components 320 such that none of the island components form any portion of the outer surface 330 of the multicomponent fiber 300. Preferably, the sea component 310 completely surrounds the island components 320 such that the sea component 310 forms a sheath 340 around the island components 320. The sheath 340 is preferably a continuous layer of the sea forming polymer around the circumference of the multicomponent fiber. An SEM image showing multicomponent fibers prepared according to the present invention is provided in FIG. 4. As seen therein, the island components are completely surrounded by the sea component such that the sea component forms a sheath around the island components.

The sheath can be defined as having a thickness that is measured between the outer surface of the multicomponent fiber and the outer edge of the islands nearest the outer surface of the multicomponent fiber. The average thickness of the sheath can vary, but the thickness is preferentially sufficient to completely wrap the islands within the sea and be capable of functioning as a protective shield during fiber spinning. In a particularly preferred embodiment, the sheath has a thickness that is greater than or equal to the average diameter of the island components within the particular multicomponent fiber. For example, in a multicomponent fiber comprising a plurality of islands having an average diameter of 500 μm, the sea forming polymer sheath surrounding the islands has a thickness of at least 500 μm.

The specifically defined sheath portion is particularly useful for overcoming multiple challenges to spinning high quality fibers. For example, the presence of the sheath can assist in avoiding premature solidification of the island components. This is beneficial in that the fibers can be properly drawn and attenuated while the islands are in a sufficiently molten state so that mechanical properties of the island components are not compromised. Moreover, the sheath can also overcome handling problems associated with relatively small extruded fibers. For example, many types of materials used in fiber preparation, such as polyamides, are plagued by static electricity problems, which make handling of the fibers particularly difficult. To overcome this problem, it is common in the art to use anti-static additives with the polymers for extrusion. According to the present invention, however, such additives are not necessary. Rather, it is possible to use a polymer for the sea component that does not have associated static electricity problems, regardless of the type of polymer used for the island components. Since the non static forming polymer is completely surrounding the static forming islands, there is no perceived induction of static charge associated with the extruded fibers, and anti-static additives can be completely avoided.

The fibers used in preparing the nonwoven spunbonded materials of the present invention also exhibit further beneficial properties. For example, preparing the I/S multicomponent fiber such that the sea component forms a sheath completely surrounding the island components provides for improved crystalline orientation of island components and the sea component. While not wishing to be bound by theory, it is believed that the island components solidify faster according to the present invention than the sea component or fibers prepared comprising 100% by weight of the polymer used in the island components. Thus, the island components experience higher spin-line stresses than the sea component and develop better molecular orientation. Moreover, the island components tend to reach final fiber spinning speed faster than the sea component of the I/S fiber. Accordingly, the presence of the island components can promote attenuation of the sea component as the result of the shearing forces acting on the interface between the components. This can at least partially account for an observed improvement of the crystalline orientation of the sea component polymer compared to homopolymer fibers prepared using the same polymer component.

As previously noted, prior art methods for preparing spunbonded materials requires the use of thermal bonding to provide strength and integrity to the spunbonded fibers. This is because the fibers are generally laid on a support in overlapping fashion and the formed web can be easily disrupted by pulling apart the fibers. Thermal bonding of the fibers at multiple points physically interconnects the overlapping fibers so that they cannot easily be torn apart. In the preparation of materials from micro- and nanofibers from I/S multicomponent fibers, though, it is a usual practice to remove the sea component to leave the islands as micro- and nanofibers. Removal of the sea, however, also generally removes the bonds formed during the thermal bonding step. Moreover, any remaining bonds are susceptible to disintegration during further downstream processing of the material. Thus, the remaining fibers are again free to be easily disrupted, which means the integrity of the material is totally compromised by the step of removing the sea component.

In the present invention, thermal bonding can be totally avoided or only optionally used. Instead, the present invention provides strength and integrity to the nonwoven spunbonded materials by mechanically entangling the multicomponent fibers. Any method recognized as useful in the art can be used to mechanically entangle the nonwoven spunbonded material prepared according to the invention. Preferably, the entangling method provides sufficient mechanical energy to entangle the multicomponent fibers to an extent wherein fibers become mechanically bonded and are imparted an inherent strength. Non-limiting examples of mechanical entangling methods useful according to the present invention include hydroentangling, needle punching, and steam jet entangling. Of course, combinations of such methods, as well the use of other methods, are fully encompassed by the present invention.

Figure 5:
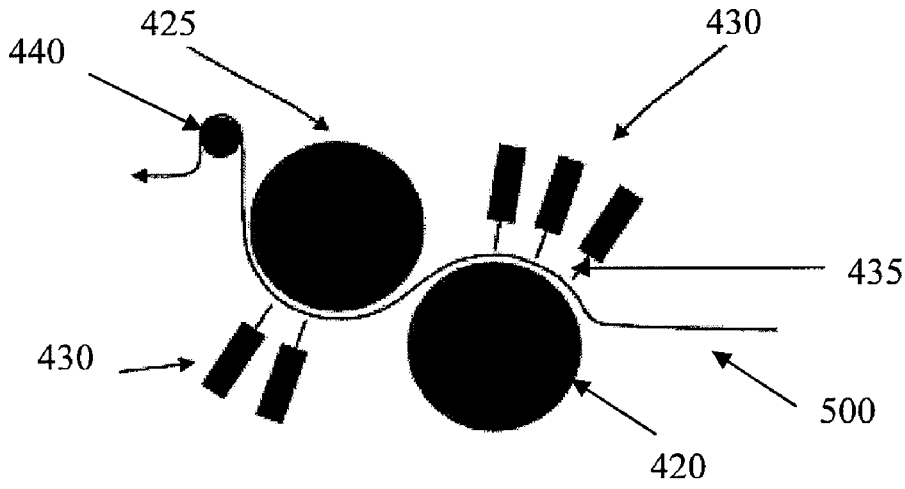
FIG. 5 is an illustration of a process for hydroentangling according to certain embodiments of the invention using a drum entangler.

One embodiment of a method for hydroentangling a nonwoven spunbonded material prepared according to the present invention is illustrated in FIG. 5. As seen therein a nonwoven web 500 enters the hydroentangling process and sequentially rolls partially around a first drum 420 and then a second drum 425. While in contact with the first drum 420, the web 500 is subject to pressurized water jets 435 provided by one or more manifolds 430. The water pressure provided can be increased or decreased as desired to increase or decrease the extent of hydroentangling, as desired. Accordingly, the mechanically entangling step of the inventive process can be referred to in terms of high energy entangling or low energy entangling. As would be understood by the skilled person, high energy entangling can be used to increase the extent of entangling and can be particularly needed when entangling a web of relatively high weight. Low energy entangling can be preferred with relatively low weight webs and can be beneficial for reducing the overall energy costs associated with the process.

The terms "high energy entangling" and "low energy entangling" can depend upon specific variables in the fabric manufacturing process. For example, the basis weight of the fabric can affect what is low energy versus high energy (e.g., what is considered high energy for a fabric of a given basis weight could be considered low energy for a fabric having a significantly greater basis weight). Likewise, entangling energy can also be relative to the speed of the overall process. In one embodiment low energy entangling of a 200 g/m$^2$ web prepared at a speed of 10 meters per minute is in the range of about 1,000 kJ/kg of fabric to about 3,000 kJ/kg of fabric. For a web of the same basis weight prepared at the same speed, high energy entangling is in the range of about 6,000 kJ/kg of fabric to about 8,000 kJ/kg of fabric. Similar values for fabrics of a differing basis weight could be easily determined by the skilled person in light of the further disclosure provided herein.

As seen in FIG. 5, the nonwoven web 500 comprises a first surface and an opposing surface. After leaving the second drum 425, the web 500 passes around an optional aligning roller 440 and can proceed for further processing. In FIG. 5, water jets 435 are illustrated in relation to both the first drum 420 and the second drum 425. Accordingly, it is possible to provide mechanical entangling to both surfaces of the nonwoven web 500. Of course, the invention also encompasses embodiments wherein mechanical entangling is only provided to only one surface of the nonwoven web. Moreover, it is possible according to the invention to provide high energy entangling to a first surface of the web and low energy entangling to an opposing surface of the web. Still further, it is possible to only provide a single position for provision of entangling energy (i.e., one drum and a single manifold or a single set of manifolds). The nonwoven web is generally described herein as having a "first surface" and an "opposing surface" for ease of description and does not necessarily limit the nonwoven spunbonded web. In preferred embodiments, the surfaces of the web are generally indistinct. Of course, it is possible to specifically treat or process the web such that the two surfaces are distinct and have separate properties, and the present invention also encompasses such embodiments.

Entangling of the web is preferably carried out to a point such that the material prepared thereby can withstand subsequent processing of the web, such as removal of the sea component of the multicomponent fiber. For example, the fibers in the material are preferably entangled to a degree that the fibers will substantially avoid protruding from the surface of the material causing a condition known as "fuzz".

The method of the invention can further comprise removal of the sea component of the multicomponent fibers forming the nonwoven spunbonded material. Any method known in the art for removing a sea component in an I/S fiber can be used. In particular, the method of removing the sea can be specifically associated with the polymer used in preparing the sea component. For example, in embodiments wherein the sea forming polymer is water soluble or water dispersible, the method of removing the sea component can comprise subjecting the nonwoven spunbonded material to water treatment. Similarly, in embodiments wherein the sea forming polymer is subject to chemical dissolution or dispersion, the method of removing the sea component can comprise subjecting the nonwoven spunbonded material to a specific chemical treatment. Of course, further methods for removing a sea component in an I/S multicomponent fiber can be used according to the present invention.

In one specific embodiment, the sea component is removed by passing the spunbonded fabric through a winch beck machine, which generally comprises a bath and a winch component for moving the fabric through the bath. Winch beck machines are known in the art and are commonly used for dyeing textiles. In a winch beck machine, the winch draws the fabric via a guide roller out of the bath and returns it in folds into the bath. In the conventional winch beck, the bath stands still, while the fabric is kept in circulation by a reel positioned in the upper part of the machine. In modern winches both the bath and the fabric are kept in circulation, which improves homogenization and exchange of the liquor with the fabric.

In embodiments where the sea component is subject to removal through contact with water or an aqueous solution, any method for causing significant contact of the fibers of the material with the aqueous component for removal of the sea component could be used according to the invention. For example, conventional jet dyeing processes could be used, as well as jet steam removal processes. Generally, any methods capable of wetting the fabric with the aqueous component and maintaining contact of the aqueous component with the fabric fibers for a time sufficient to allow the solvent to remove the sea component can be used. Preferably, such methods are followed by a wash stage to remove the dissolved sea component and any residual reactants.

As previously noted, the sea component can be removed using a variety of methods and reactants. Generally, where a reactant is used to remove the sea component, such removal can be carried out by contacting the fibers with the reactant for a time sufficient to at least partially remove the sea component. For example, in embodiments where organic materials in the liquid state are used, the fibers could be subjected to methods such as described above for sea removal. Alternate methods, such as placing the fibers in a vapor chamber, could also be used and would be apparent to the skilled person with the benefit of the present disclosure and knowledge of the physical characteristics of the sea component.

Figure 6:
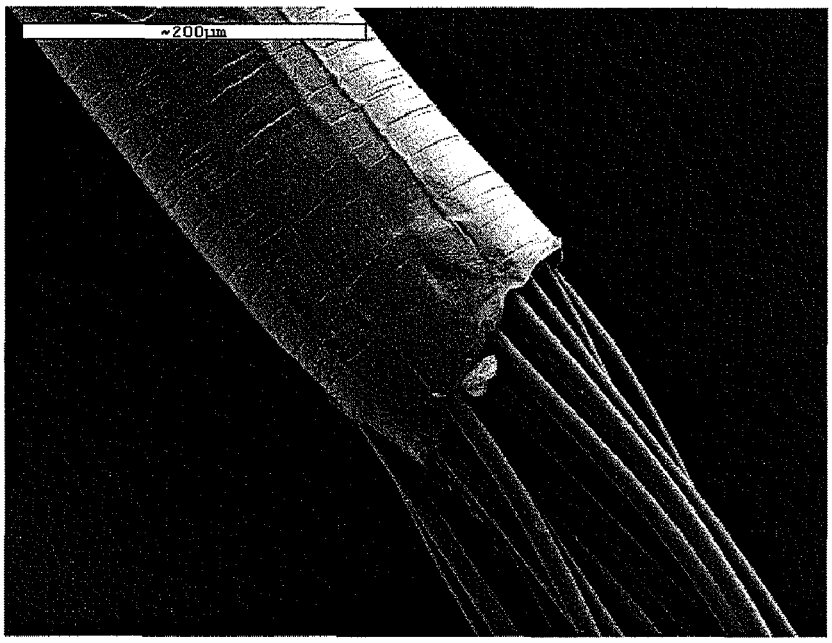
FIG. 6 is an SEM image showing a multicomponent fiber according to one embodiment of the invention having the sea component partially removed to reveal the individual island components.

The nonwoven spunbonded materials prepared according to the present invention are particularly useful in that the multicomponent fibers can be treated to remove the sea component and leave behind a material comprising micro- and nanofibers without compromising the integrity of the material. An SEM image showing a multicomponent fiber according to one embodiment of the invention having the sea component partially removed to reveal the individual island components is illustrated in FIG. 6.

Since the multicomponent fibers are mechanically entangled as described above, the island components present within the multicomponent fibers remain entangled after removal of the sea component. The remaining material is a nonwoven spunbonded web formed of micro- and nanofibers. In certain embodiments, thermal bonding can be combined with the mechanical entangling methods. Such thermal bonding can be used before or after removal of the sea component. Of course, it is recognized that while thermal bonding can add strength to the nonwoven spunbonded material prepared according to the present invention, the use of thermal bonding is purely optional. For example, the use of thermal bonding after removal of the sea component has been shown to provide mild increases in tensile strength, likely arising from an increased stiffness; however, such thermal bonding has also been shown to decrease the tear strength of a hydroentangled web prepared according to the invention. Accordingly, in relation to mechanical properties, the usefulness of thermal bonding is limited. Thermal bonding after removal of the sea component, though, can be useful for improving pilling and abrasion resistance of the prepared material. For example, calendaring of a material typically ties down the fibers on the fabric surface, and this in turn increases resistance to pilling (or formation of fabric pills on the surface of the fabric), as well as abrasion resistance.

The method of the invention allows for the preparation of high strength materials comprising micro- and nanofibers through spunbonding of multicomponent fibers. In specific embodiments, the fibers comprise I/S fibers, and the sea component is removed to leave behind micro- and nanofibers. The resulting size of the fibers (e.g., micro, nano, or micro and nano) can depend upon a variety of factors. Generally, if the number of islands remains constant, a multicomponent fiber with a smaller average diameter will produce islands having smaller average diameters and a multicomponent fiber having a larger average diameter. Moreover, if the average diameter of the multicomponent fiber remains constant, a multicomponent fiber with a greater number of islands will produce islands having smaller average diameters that a multicomponent fiber with a lesser number of islands. Island diameter is also related to the ratio of the sea component to the island components. As the ratio of sea component increases, the average diameter of the islands decreases.

Figure 7:
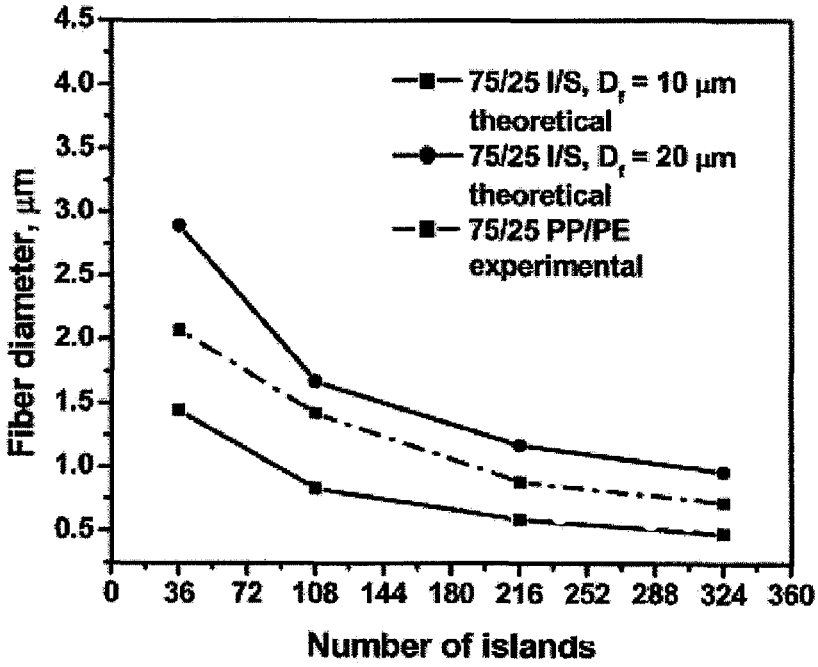
FIG. 7 is a chart illustrating the relationship between the average diameter of the multicomponent fiber, the number of islands formed within the fiber, and the average diameter of the islands.
Figure 8:
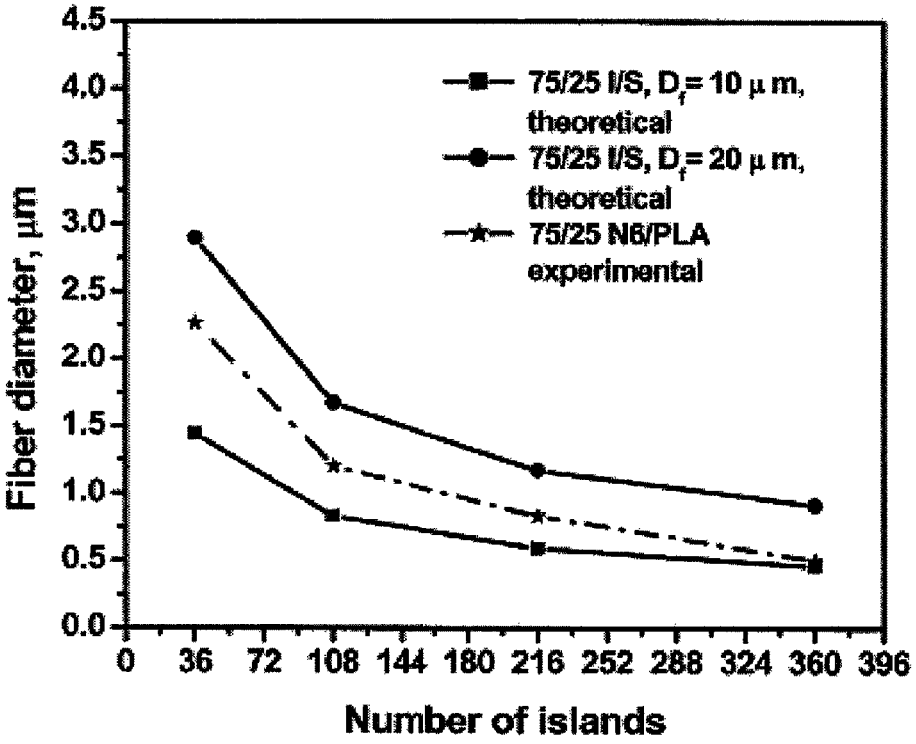
FIG. 8 is another chart illustrating the relationship between the average diameter of the multicomponent fiber, the number of islands formed within the fiber, and the average diameter of the islands.

The above conditions are supported by both theoretical calculations and actual experimental data. The relationship between the average diameter of the multicomponent fiber, the number of islands present in the multicomponent fiber, and the average diameter of the islands within the multicomponent fiber is illustrated in FIG. 7 and FIG. 8. In FIG. 7, theoretical calculations for multicomponent fibers having the following composition are provided: 75/25 islands/sea ratio and an average multicomponent fiber diameter of 10 μm; and 75/25 islands/sea ratio and an average multicomponent fiber diameter of 20 μm. Experimental data is shown for a multicomponent fiber with a 75/25 islands/sea ratio and an average diameter of 16-18 μm (wherein the islands comprise polypropylene and the sea comprises polyethylene). As seen in FIG. 7, the average diameter of the islands decreases with an increase in the number of islands present in a given multicomponent fiber. In FIG. 8, the theoretical data is the same, and the experimental data is shown for a multicomponent fiber with a 75/25 islands/sea ratio and an average diameter of 14-16 μm (wherein the islands comprise nylon-6 and the sea comprises poly(lactic) acid (PLA)). Again, the average diameter of the islands decreases with an increase in the number of islands present in a given multicomponent fiber. This is further illustrated in the Examples below.

As evident from the description provided herein, the properties of the nonwoven spunbonded material prepared according to the present invention can be at least partially determined by the properties of the multicomponent fiber extruded to form the spunbonded web. Moreover, the desired properties of the nonwoven spunbonded material can be achieved by optimizing multiple fiber dimensions and properties. For example, by extruding a multicomponent fiber having a specified average diameter, specified number of islands, and specified island to sea ratio, a nonwoven spunbonded fabric can be prepared having specific mechanical and physical properties, as further described below.

Accordingly, the method of the present invention can be further described in terms of the specific properties of the extruded fibers. Preferentially, the invention comprises the preparation of materials incorporating micro- and nano fibers, and such micro- and nano fibers can be provided initially as island components in an I/S multicomponent fiber that are released by removal of the sea component of the fiber. Accordingly, the invention encompasses the use of micro- and nanofibers having an average diameter of about 5 μm or less.

In certain embodiments, it is preferred for the step of extruding the multicomponent fibers to comprise forming a multicomponent fiber comprising island components having an average diameter in the range of about 50 nm to about 5 μm. In further embodiments, the multicomponent fiber is extruded to form a multicomponent fiber comprising islands having an average diameter in the range of about 50 nm to about 3 μm, about 50 nm to about 2 μm, about 50 nm to about 1 μm, about 100 nm to about 1 μm, about 100 nm to about 800 nm, about 200 nm to about 800 nm, or about 300 nm to about 800 nm.

Figure 4:
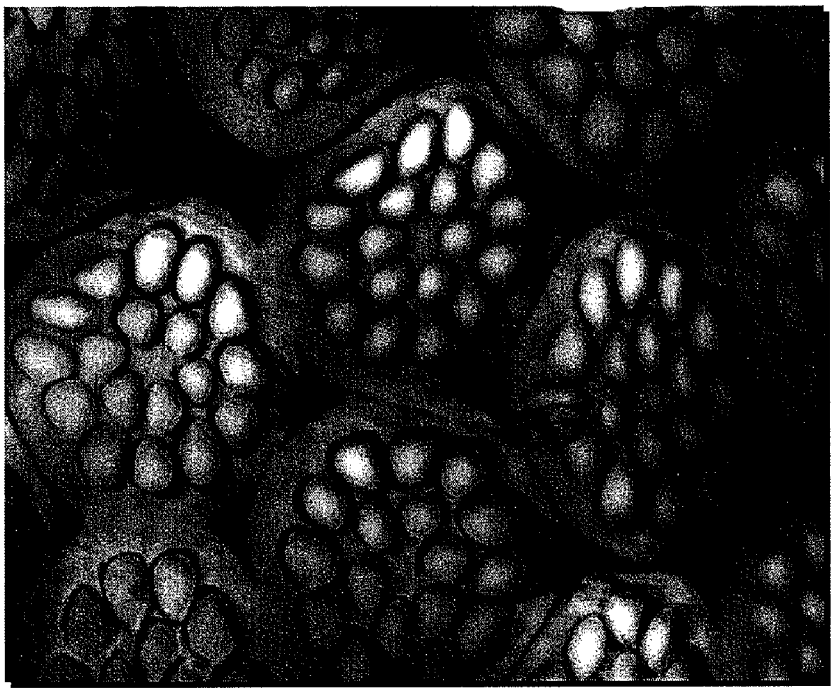
FIG. 4 is an SEM image showing (in cross-section) multicomponent fibers prepared according to one embodiment of the present invention having 18 island components, all of which are completely surrounded by a sheath formed by the sea component.
Figure 9:
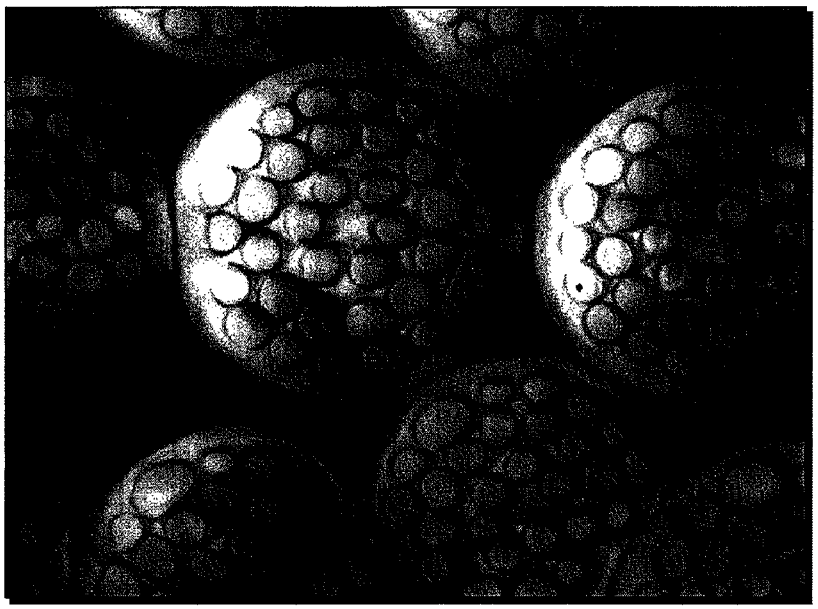
FIG. 9 is an SEM images showing (in cross-section) multicomponent fibers prepared according to one embodiment of the invention having 36 island components.
Figure 10:
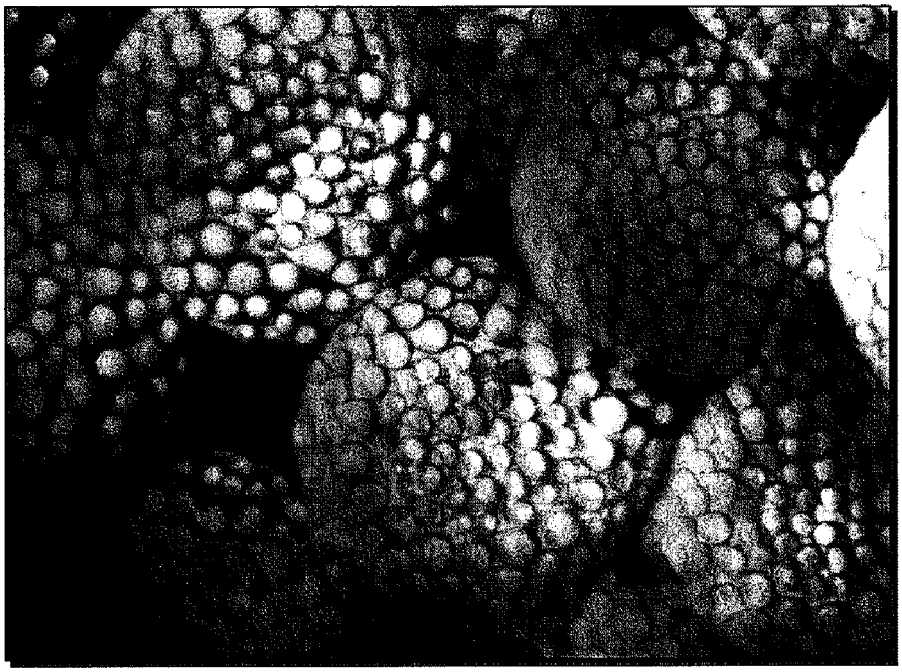
FIG. 10 is an SEM images showing (in cross-section) multicomponent fibers prepared according to one embodiment of the invention having 108 island components.
Figure 11:
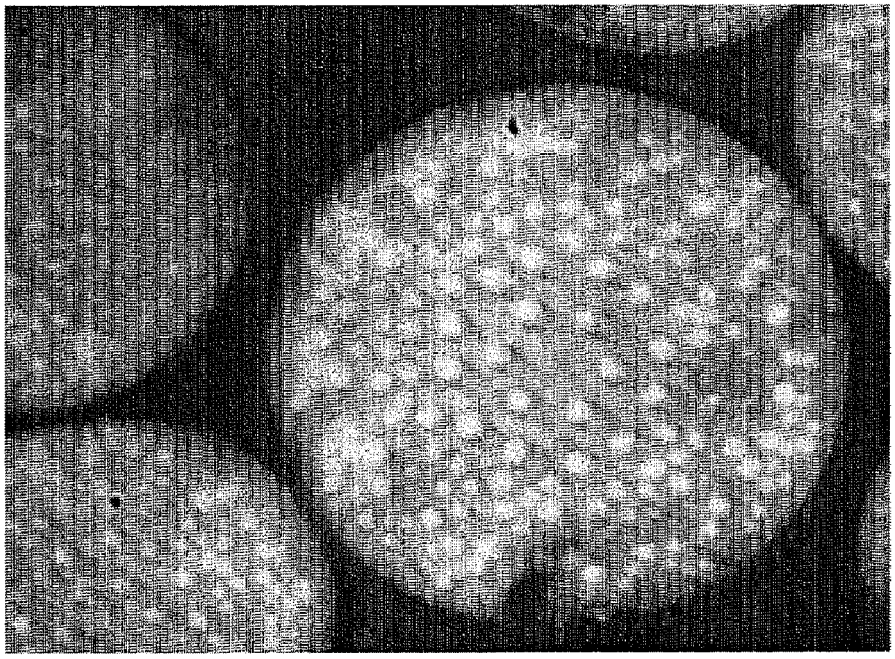
FIG. 11 is an SEM images showing (in cross-section) multicomponent fibers prepared according to one embodiment of the invention having 216 island components.
Figure 12:
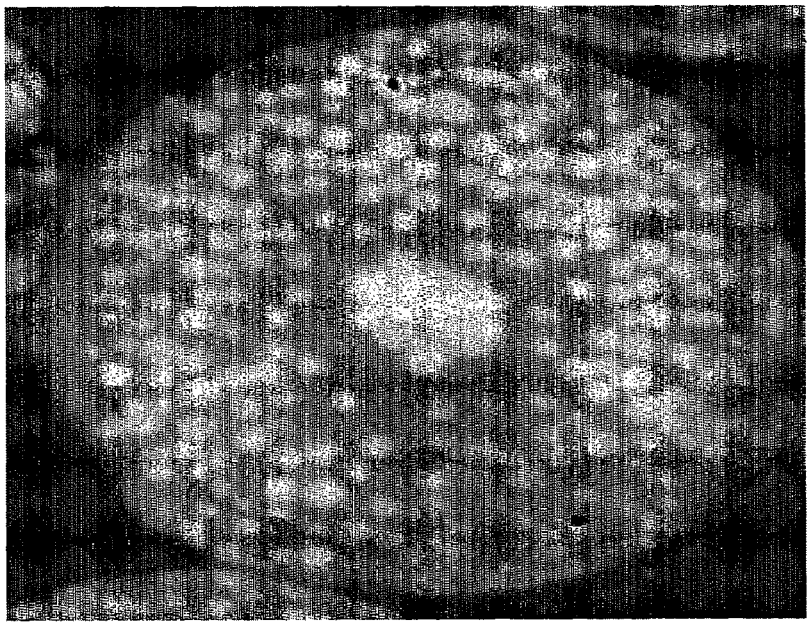
FIG. 12 is an SEM images showing (in cross-section) multicomponent fibers prepared according to one embodiment of the invention having 360 island components.

The multicomponent fiber prepared in the method of the present invention can also be extruded so that the multicomponent fiber comprises a defined number of island components. Preferably, the multicomponent fiber comprises up to about 1000 island components. In further embodiments, the multicomponent fiber comprises between about 2 and about 1000 island components, between about 36 and about 1000 island components, between about 36 and about 800 island components, between about 36 and about 600 island components, or between about 36 and about 400 island components. SEM images showing various embodiments of multicomponent fibers prepared according to the invention are illustrated in FIG. 4 (cross-section of a multicomponent fiber having 18 island components), FIG. 9, (cross-section of a multicomponent fiber having 36 island components), FIG. 10, (cross-section of a multicomponent fiber having 108 island components), FIG. 11, (cross-section of a multicomponent fiber having 216 island components), and FIG. 12 (cross-section of a multicomponent fiber having 360 island components).

In yet further embodiments, the multicomponent fiber can be extruded so that the multicomponent fiber comprises a defined ratio of island component to sea component (i.e., an "island/sea ratio"). Preferably, the fiber is extruded such that the multicomponent fiber comprises a greater proportion of the island component than the sea component. In particular embodiments, the fiber is extruded such that the multicomponent fiber comprises an island/sea ratio in the range of about 95/5 to about 5/95, about 85/15 to about 15/85, or about 75/25 to about 25/75.

The relationship between average multicomponent fiber diameter, I/S ratio, the number of islands present in the multicomponent and the average diameter of the island components after removal of the sea can be calculated according to Formula (1) provided below $$d_{isl} = \sqrt{\frac{R_{isl}}{N}}\, D_f \tag{1}$$

wherein $d_{isl}$ is the diameter of the island fibers after dissolving of the sea component, N is the number of island components present in the multicomponent fiber, $R_{isl}$ is the ratio of island components to sea component, and $D_f$ is the diameter of the multicomponent fiber before removal of the sea component. Various I/S multicomponent fiber embodiments possible according to the invention and illustrating the influence of island count and I/S rations on the average diameter of the island component are shown below in Table 1.

TABLE 1

| Number of Islands | Initial Multicomponent Fiber Diameter (Df) = 10 μm Island Component Diameter ($d_{isl}$) After Removal of Sea Component (μm) Island/Sea Ratio | | | Initial Multicomponent Fiber Diameter (Df) = 20 μm Island Component Diameter ($d_{isl}$) After Removal of Sea Component (μm) Island/Sea Ratio | | |
|---|---|---|---|---|---|---|
| (N) | 25/75 | 50/50 | 75/25 | 25/75 | 50/50 | 75/25 |
| 36 | 0.83 | 1.18 | 1.44 | 1.67 | 2.36 | 2.89 |
| 72 | 0.59 | 0.83 | 1.02 | 1.18 | 1.67 | 2.04 |
| 108 | 0.48 | 0.68 | 0.83 | 0.96 | 1.36 | 1.67 |
| 144 | 0.42 | 0.59 | 0.72 | 0.83 | 1.18 | 1.44 |
| 180 | 0.37 | 0.53 | 0.64 | 0.74 | 1.05 | 1.29 |

TABLE 1-continued

| Number of Islands | Initial Multicomponent Fiber Diameter (Df) = 10 μm Island Component Diameter ($d_{isl}$) After Removal of Sea Component (μm) Island/Sea Ratio | | | Initial Multicomponent Fiber Diameter (Df) = 20 μm Island Component Diameter ($d_{isl}$) After Removal of Sea Component (μm) Island/Sea Ratio | | |
|---|---|---|---|---|---|---|
| (N) | 25/75 | 50/50 | 75/25 | 25/75 | 50/50 | 75/25 |
| 216 | 0.34 | 0.48 | 0.59 | 0.68 | 0.96 | 1.17 |
| 252 | 0.31 | 0.44 | 0.54 | 0.63 | 0.89 | 1.09 |
| 288 | 0.29 | 0.42 | 0.51 | 0.59 | 0.83 | 1.02 |
| 324 | 0.28 | 0.39 | 0.48 | 0.55 | 0.79 | 0.96 |
| 360 | 0.26 | 0.37 | 0.46 | 0.53 | 0.74 | 0.91 |
| 600 | 0.20 | 0.29 | 0.35 | 0.41 | 0.58 | 0.71 |
| 1000 | 0.16 | 0.22 | 0.27 | 0.32 | 0.45 | 0.55 |

The methods of the present invention allow for the preparation of nonwoven spunbonded materials comprising micro- and nanofibers. This is particularly useful in that such materials can be lightweight while still providing excellent mechanical properties, such as high strength. The nonwoven spunbonded materials of the present invention exhibit high strength in both the machine direction (MD) (i.e., the direction in which the extruded fibers were laid on the moving belt) and the cross machine direction (CD). The strength of the nonwoven spunbonded material can particularly be evaluated in terms of tensile strength and tear strength. As would be recognizable by the skilled person, such properties in relation to a nonwoven material can change depending upon the overall web weight (i.e., the mass of the web per given area). To establish a standardized basis, the tear strength and tensile strength values provided for the nonwoven spunbonded materials prepared according to the present invention are provided on a basis weight of 100 g/m$^2$ (herein referred to as "the normalized basis").

While not intending to be so limited, the values provided herein for various mechanical and physical properties are particularly seen in materials prepared using micro- and nanofibers formed of a polyamide (e.g., nylon-6). In other words, the fibers are left after removal of the sea component of a multicomponent fiber formed comprising polyamide island components. Of course, the values provided herein are also relative to other polymer types and are not necessarily intended to be limited to polyamides.

One of skill in the art would readily be capable of making a head-to-head evaluation of the mechanical properties of the nonwoven spunbonded materials prepared according to the present invention against materials made by other methods and possibly having a different basis weight. Such is easily achieved by converting to a normalized basis weight using Formula (2) provided below $$P_N = P_O \cdot (B_n / B_o) \quad (2)$$

wherein $P_N$ is the normalized property being evaluated, $P_O$ is the observed property value, $B_n$ is the chosen nominal basis weight, and $B_o$ is the observed basis weight of the material being evaluated.

In preferred embodiments, the nonwoven spunbonded materials prepared according to the method of the present invention (including removal of the sea component) have a normalized MD tensile strength of at least about 25 N. In further embodiments, the nonwoven spunbonded materials have a normalized MD tensile strength of at least about 50 N, at least about 100 N, at least about 150 N, at least about 200 N, at least about 250 N, or at least about 300 N. In other embodiments, the nonwoven spunbonded materials have a normalized CD tensile strength of at least about 25 N, at least about 50 N, at least about 100 N, or at least about 125 N. The above values are provided on a 100 g/m$^2$ normalized basis.

The nonwoven spunbonded materials prepared according to the method of the present invention can further be characterized in terms of their tear strength. In preferred embodiments, the nonwoven spunbonded materials have a normalized MD tear strength of at least about 25 N. In further embodiments, the nonwoven spunbonded materials have a normalized MD tear strength of at least about 50 N, at least about 75 N, at least about 100 N, or at least about 125 N. In other embodiments, the nonwoven spunbonded materials have a normalized CD tear strength of at least about 50 N, at least about 75 N, at least about 100 N, at least about 125 N, at least about 150 N, or at least about 175 N. The above values are provided on a 100 g/m$^2$ normalized basis.

The nonwoven spunbonded materials prepared according to the present invention also exhibit excellent physical properties, such as absorbent capacity, absorbency rate, and air permeability. Absorbent capacity generally describes the ability of the material to absorb liquid into the fibers and can be referred to as capillary absorption, which is generally determined by the size of the capillaries in the material. Absorbent capacity can be calculated based on the volume of liquid absorbed by a given weight of dry fabric. Absorbency rate is determined by the size and orientation of capillaries in the fabric, as well as surface properties of the fabric and the individual fibers and liquid properties of the liquid being absorbed. Absorbency rate can be calculated as the volume of liquid absorbed by a given weight of dry fabric over a given time.

Figure 13:
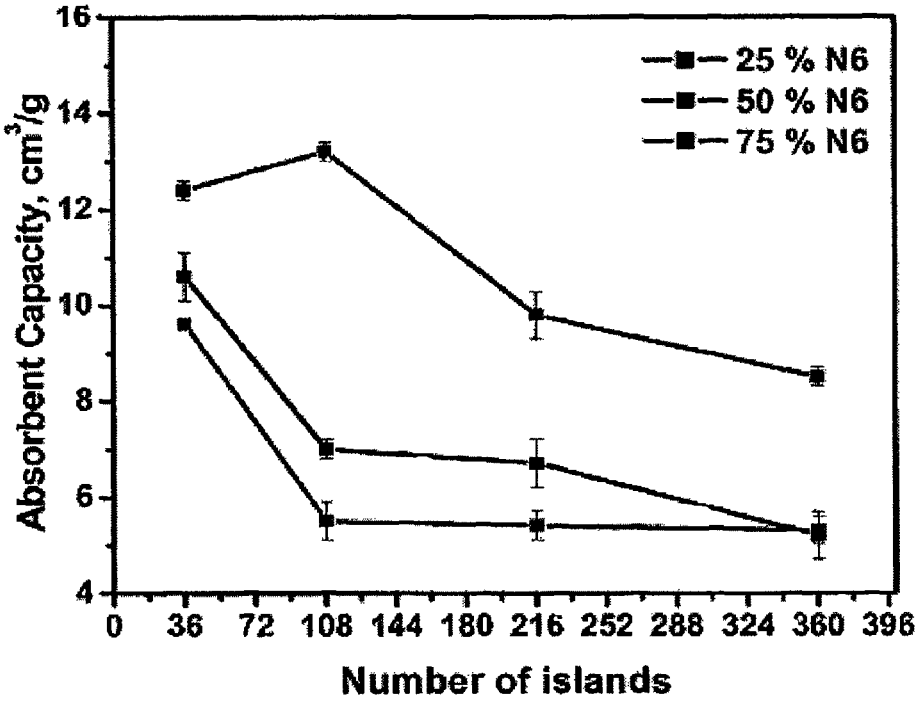
FIG. 13 is a chart illustrating absorbent capacity in a nonwoven spunbonded materials according to certain embodiments of the invention as a function of the number of islands formed in the multicomponent fibers.
Figure 14:
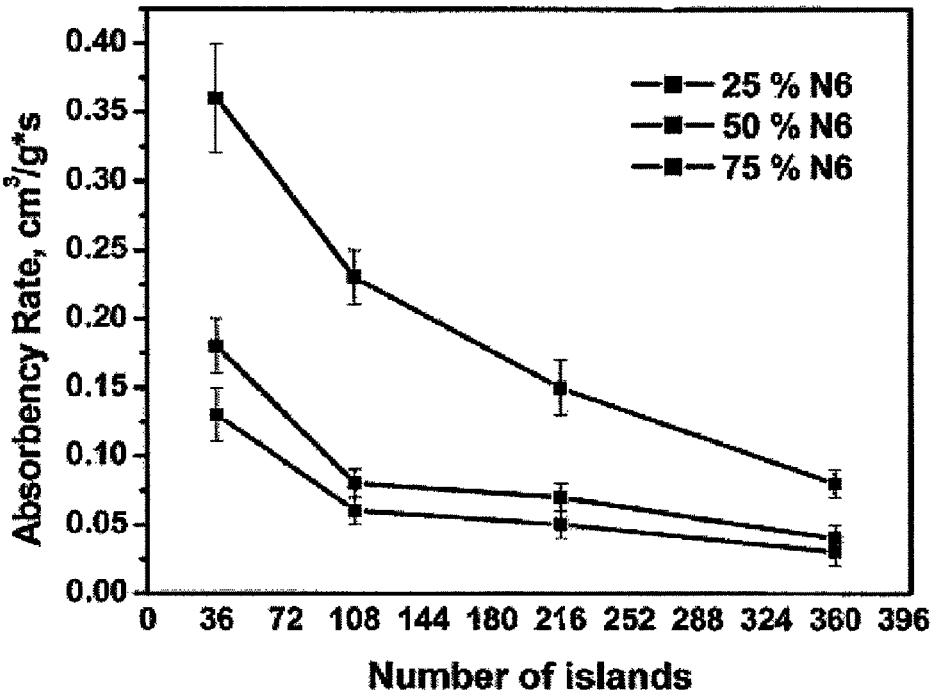
FIG. 14 is a chart illustrating absorbency rate in a nonwoven spunbonded materials according to certain embodiments of the invention as a function of the number of islands formed in the multicomponent fibers.

As illustrated in FIG. 13 and FIG. 14, absorbent capacity and absorbency rate for fabrics prepared according to certain embodiments of the invention tends to decrease as the number of islands used to prepare the multicomponent fibers increases. Such change generally arises from an overall increase in the bulk density of the nonwoven spunbonded fabric when using a greater number of islands in the multicomponent fibers. Preferably, the nonwoven spunbonded materials prepared according to the present invention exhibit an absorbent capacity of at least about 5 cm$^3$/g. In further embodiments, the nonwoven spunbonded materials exhibit an absorbent capacity of at least about 7 cm$^3$/g, at least about 10 cm$^3$/g, or at least about 12 cm$^3$/g. Moreover, the nonwoven spunbonded materials prepared according to the present invention preferentially exhibit an absorbency rate of at least about 0.025 cm$^3$/g·s. In further embodiments, the nonwoven spunbonded materials exhibit an absorbency rate of at least about 0.05 cm$^3$/g·s, at least about 0.1 cm$^3$/g·s, at least about 0.15 cm$^3$/g·s, at least about 0.2 cm$^3$/g·s, at least about 0.25 cm$^3$/g·s, or at least about 0.3 cm$^3$/g·s.

Figure 15:
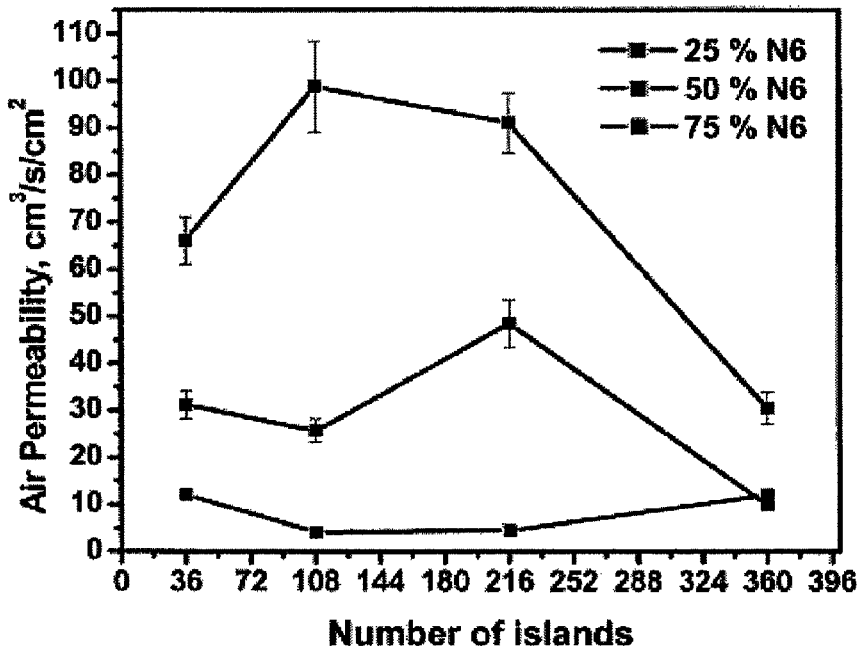
FIG. 15 is a chart illustrating air permeability in a nonwoven spunbonded materials according to certain embodiments of the invention as a function of the number of islands formed in the multicomponent fibers.

Air permeability of the inventive materials can also vary with the number of islands present in the extruded multicomponent fibers. Such change is illustrated in FIG. 15. Air permeability can be calculated as the volume of air per second passing through a defined area of fabric. Preferably, the nonwoven spunbonded material prepared according to the present invention exhibits an air permeability of at least about 5 (cm$^3$/s)/cm$^2$. In further embodiments, the nonwoven spunbonded material exhibits an air permeability of at least about 10 (cm$^3$/s)/cm$^2$, at least about 25 (cm$^3$/s)/cm$^2$, at least about 50 (cm$^3$/s)/cm$^2$, at least about 75 (cm$^3$/s)/cm$^2$, or at least about 90 (cm$^3$/s)/cm$^2$.

EXPERIMENTAL

The present invention will now be described with specific reference to various examples. The following examples are not intended to be limiting of the invention and are rather provided as exemplary embodiments.

Example 1

Preparation of Spunbond Web

Using Bicomponent Fibers

Bicomponent I/S fibers were prepared using ULTRAMID® BS 700 nylon-6 polymer (available from BASF) as the island components and PLA as the sea polymer. Polymer properties are provided below in Table 2. The bicomponent fibers were prepared to have 36, 108, 216, or 360 island components using standard spinning methods as described herein and continuously laid on a forming belt to form a nonwoven web. The nonwoven web was hydroentangled at a speed of 30 m/min to form a nonwoven spunbonded fabric. The total hydroentangling energy used was 8000 kJ/kg. The basis weight of the fabric was maintained at 170 g/m$^2$ for all samples. A description of the samples prepared is provided below in Table 3.

The PLA sea was removed in a winch beck machine by treating the fabric for 10 minutes in a 3% solution of caustic soda in water at a temperature of 100° C. The basis weight of the fabric after removal of 25% of the PLA sea was 140 g/m$^2$. The basis weight of the fabric after removal of 75% of the PLA sea was 50 g/m$^2$.

TABLE 2

| Polymer | Melt Temp. | Density | Viscosity |
|---|---|---|---|
| Nylon-6 | 220° C. | 1.14 g/cm$^3$ | 2.67-2.73 |
| PLA | 173° C. | 1.25 g/cm$^3$ | NA |

TABLE 3

| Sample | Sea Polymer | Island Polymer | No. of Islands | Island/Sea Ratio |
|---|---|---|---|---|
| 1 | Nylon-6 | NA | NA | 0/100 |
| 2 | PLA | NA | NA | 0/100 |
| 3 | PLA | Nylon-6 | 36 | 25/75 |
| 4 | PLA | Nylon-6 | 36 | 75/25 |
| 5 | PLA | Nylon-6 | 108 | 25/75 |
| 6 | PLA | Nylon-6 | 108 | 75/25 |
| 7 | PLA | Nylon-6 | 216 | 25/75 |
| 8 | PLA | Nylon-6 | 216 | 75/25 |
| 9 | PLA | Nylon-6 | 360 | 25/75 |
| 10 | PLA | Nylon-6 | 360 | 75/25 |

Example 2

Crystallinity and Crystalline Orientation

Wide-angle X-ray scattering (WAXS) profiles of the fibers prepared in Example 1 were obtained by Omni Instrumental X-ray diffractometer with a Be-filtered CuKα radiation source (λ=1.54 Å) generated at 30 kV and 20 mA. The I/S fibers were manually wound in a tightly packed flat layer of parallel fibers onto a holder prior to the examination. The samples were equatorially scanned at the rate 0.2° min$^{-1}$ from 2θ=10°-35° in the reflection geometry for a count time of 2.5 seconds. Intensity curves of the equatorial scans were resolved into peaks at 2θ=22° for nylon-6 fibers and at 2θ=16.5° for PLA fibers. To calculate Herrman's orientation functions, transmission scans of the samples at the rate of 0.5° min$^{-1}$ and count time 1 second at fixed diffraction angles were performed.

Figure 16A:
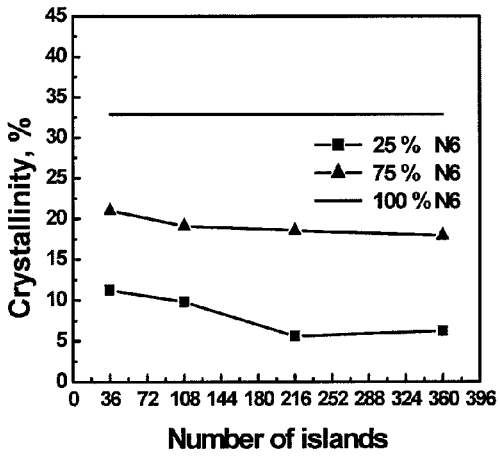
FIG. 16*a* is a chart illustrating the crystallinity of the nylon-6 phase of nylon-6 homocomponent fibers and nylon-6/PLA multicomponent fibers prepared according to certain embodiments of the present invention as a function of the number of island components for different polymer ratios.
Figure 16B:
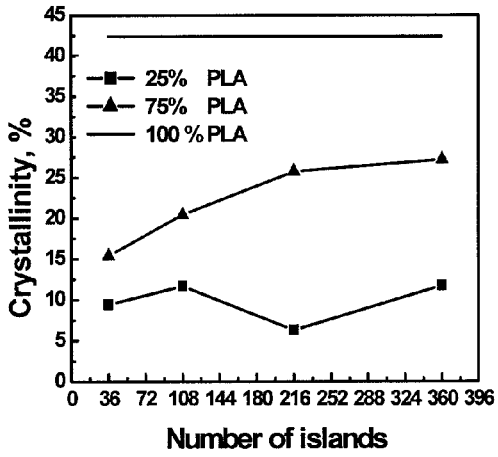
FIG. 16*b* is a chart illustrating the crystallinity of the PLA phase of PLA homocomponent fibers and nylon-6/PLA multicomponent fibers prepared according to certain embodiments of the present invention as a function of the number of island components for different polymer ratios.

The relationships between the number of islands and crystallinity of the nylon-6 and PLA phases in the I/S fibers are illustrated in FIG. 16*a* and FIG. 16*b*, respectively. Bicomponent fibers made up of 36 islands showed the highest crystallinity for the nylon-6 component, which decreased slightly as the number of islands increased from 36 to 360. The fibers with 360 islands exhibited the highest degree of crystallinity for the PLA phase. Overall, the crystallinities of both components of the I/S fibers were lower than the crystallinities of pure nylon-6 and PLA fibers.

Figure 17A:
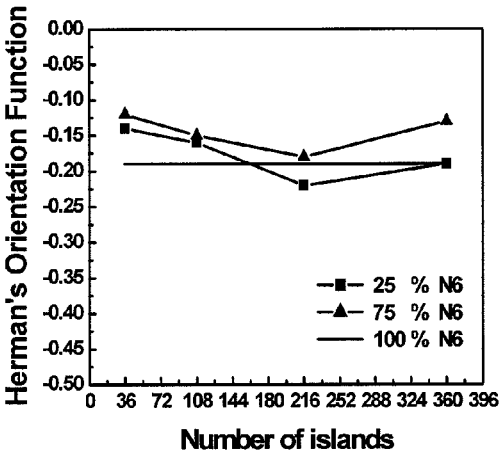
FIG. 17*a* is a chart illustrating the crystalline orientation of the nylon-6 phase of nylon-6 homocomponent fibers and nylon-6/PLA multicomponent fibers prepared according to certain embodiments of the present invention as a function of the number of island components for different polymer ratios.
Figure 17B:
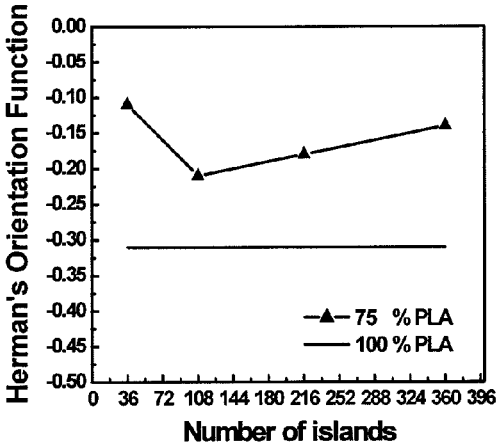
FIG. 17*b* is a chart illustrating the crystalline orientation of the PLA phase of PLA homocomponent fibers and nylon-6/PLA multicomponent fibers prepared according to certain embodiments of the present invention as a function of the number of island components for different polymer ratios.

The Herrman's orientation functions for the nylon-6 and PLA phases of the I/S fibers as functions of the number of islands are illustrated in FIG. 17*a* and FIG. 17*b*, respectively. This value describes the orientation of the polymer chains in relation to the fiber axis, wherein a value of 1 indicates perfect orientation of the polymer chains along the fiber axis, and a value of −0.5 indicates perfect orientation of the polymer chains perpendicular to the fiber axis.

The Herrman's orientation function of the nylon-6 component declined as the number of islands increased from 36 to 216. Further increases in the island count from 216 to 360 caused an increase in the crystalline orientation function of the nylon-6 phase. The 108 I/S fibers demonstrated the lowest Herrman's orientation function of the PLA component, and this function increased as the number of islands composing the bicomponent fibers increased from 108 to 360. Fibers containing 36 islands demonstrated the highest values of the Herrman's orientation functions for both phases. Overall, nylon-6 and PLA components of the bicomponent fibers as well as 100% nylon-6 and PLA fibers showed low orientation of their polymer chains in the crystalline regions. However, the axial alignment of the component polymer chains was found to be better than the alignment of the polymer chains of the homo-component nylon-6 and PLA fibers along the fiber axis.

Example 3

Fiber Mechanical Properties

Before and After PLA Sea Removal

Figure 18:
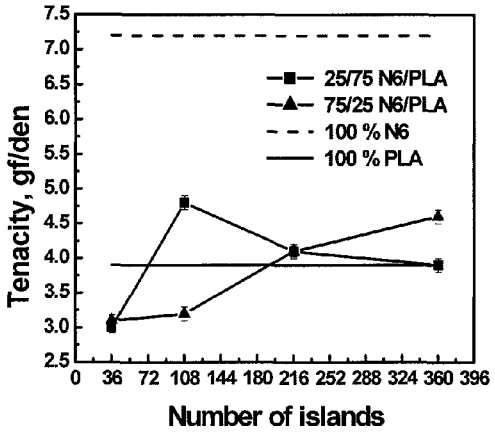
FIG. 18 is a chart illustrating the tenacity of nylon-6/PLA multicomponent fibers prepared according to certain embodiments of the present invention as a function of the number of island components for different polymer ratios.
Figure 19:
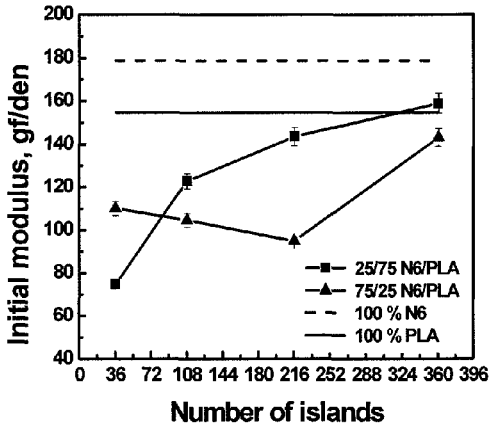
FIG. 19 is a chart illustrating the initial modulus of nylon-6/PLA multicomponent fibers prepared according to certain embodiments of the present invention as a function of the number of island components for different polymer ratios.
Figure 20:
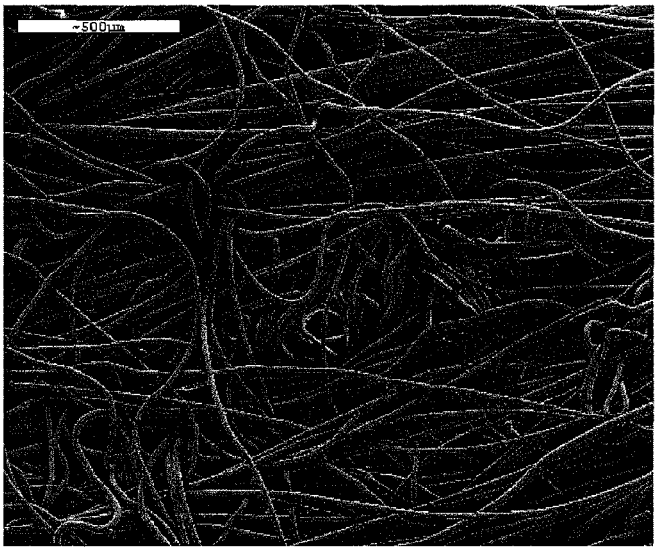
FIG. 20 is an SEM image of a hydroentangled fabric before removal of the sea component prepared according to one embodiment of the invention using multicomponent fibers having 216 island components.
Figure 21:
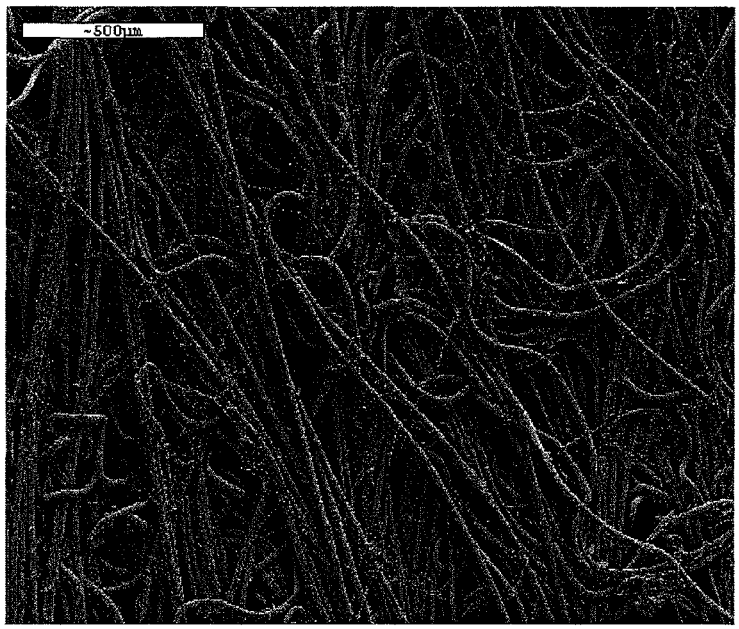
FIG. 21 is an SEM image of a hydroentangled fabric before removal of the sea component prepared according to one embodiment of the invention using multicomponent fibers having 360 island components.

Tenacity and initial modulus properties of the composite I/S fibers prepared according to Example 1 (without removing PLA) are illustrated in FIG. 18 and FIG. 19, respectively. With the exception of tenacity for the filaments with 25% nylon-6, all fibers containing 360 islands showed the highest tenacity and initial modulus. Overall, the I/S fibers demonstrated performance similar to that of PLA homo-component filaments, which had a lower elongation to break than 100% nylon-6 fibers. Thus, the I/S fibers tended to exhibit tensile properties similar to those of 100% PLA fibers. The degree of entangling of the multicomponent fibers can be seen in FIG. 20 and FIG. 21. FIG. 20 provides an SEM image of a hydroentangled fabric before removal of the sea component prepared according to the invention having 216 island components. FIG. 21 provides an SEM image of a hydroentangled fabric before removal of the sea component prepared according to the invention having 360 island components.

Figure 22:
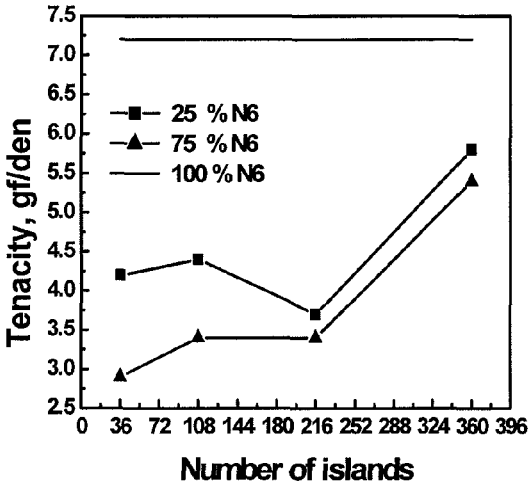
FIG. 22 is a chart illustrating the tenacity of nylon-6 fibers as islands remaining from a nylon-6/PLA multicomponent fiber prepared according to certain embodiments of the present invention after removal of the PLA sea as a function of the number of islands formed in the original multicomponent fiber.
Figure 23:
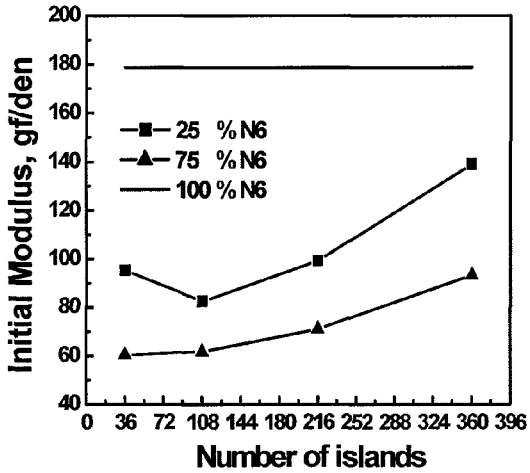
FIG. 23 is a chart illustrating the initial modulus of nylon-6 fibers as islands remaining from a nylon-6/PLA multicomponent fiber prepared according to certain embodiments of the present invention after removal of the PLA sea as a function of the number of islands formed in the original multicomponent fiber.
Figure 24:
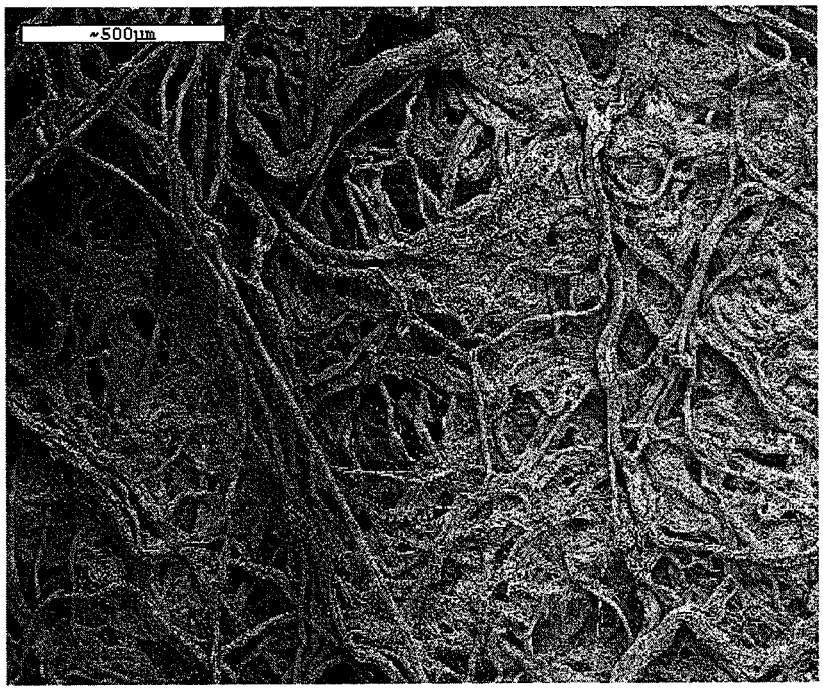
FIG. 24 is an SEM image of the hydroentangled fabric from FIG. 20 after removal of the sea component.
Figure 25:
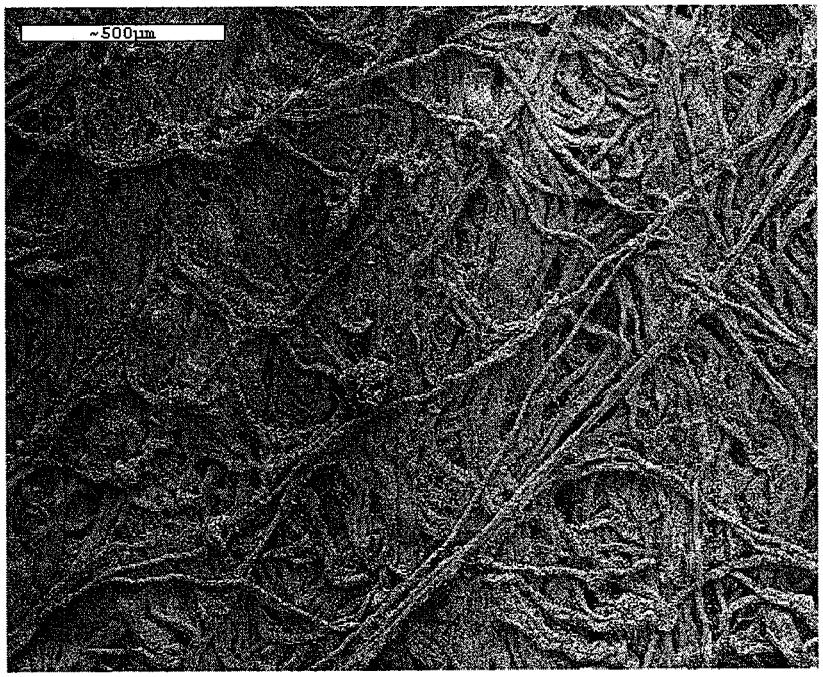
FIG. 25 is an SEM image of the hydroentangled fabric from FIG. 21 after removal of the sea component.

Tenacity and initial modulus properties of the nylon-6 islands after the removal of PLA from the nylon-6/PLA I/S fibers are illustrated in FIG. 22 and FIG. 23, respectively. The data show that the values of the fiber tenacity and initial modulus grew as the number of islands in the initially prepared multicomponent fibers increased from 36 to 360. The majority of the nylon-6 fibers exhibited performance superior to that of the I/S fibers. Overall, the nylon-6 fibers originally made up of 360 islands showed the highest tenacity and modulus values. FIG. 24 and FIG. 25 show the fabrics illustrated in FIG. 20 and FIG. 21, respectively, after removal of the sea component. As seen, the large number of micro- and nano-fibers provided by the freed island components provides for a densely entangled composition accounting for many of the improved physical and mechanical properties exhibited by the inventive fabrics.

Example 4

Fiber Diameter after Removal of PLA Sea

Figure 26:
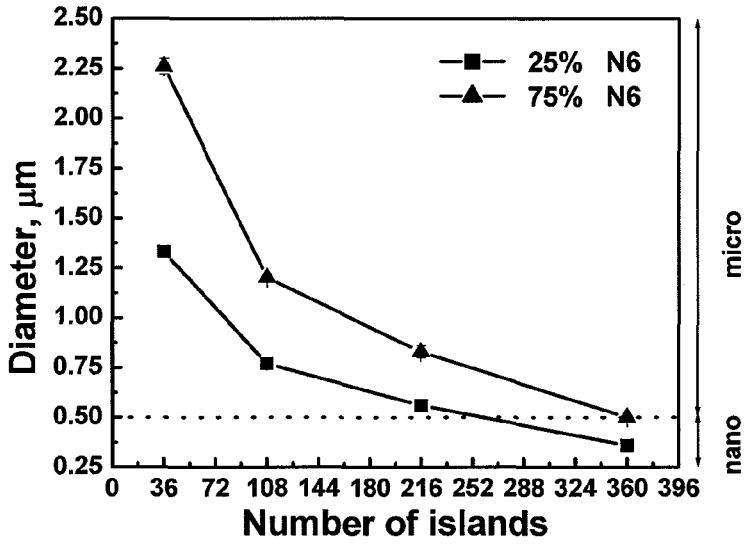
FIG. 26 is a chart illustrating island diameter after removal of the sea component as a function of the number of islands originally present in the multicomponent fiber.

The diameters of the nylon-6 fibers (islands) after the removal of the sea were measured, and the results are provided below in Table 4 and are graphically illustrated in FIG. 26. Average island diameter decreased as the number of islands increased and as the ratio of the sea component to the island components increased. The fibers with 25% nylon-6 showed a decrease in fiber diameter from 1.3 to 0.36 microns when the number of islands was increased from 36 to 360. The diameter of fibers with 75% nylon-6 showed a decline from 2.3 to 0.5 micron for the same range. The initial diameter of the multicomponent fiber was 13 μm or 1.5 dpf (denier per filament).

TABLE 4

| Number of Islands | 75/25 I/S | 50/50 I/S | 25/75 I/S |
|---|---|---|---|
| 36 | 2.26 μm | 1.78 μm | 1.33 μm |
| 108 | 1.2 μm | 1.0 μm | 0.77 μm |
| 216 | 0.83 μm | 0.67 μm | 0.56 μm |
| 360 | 0.50 μm | 0.48 μm | 0.36 μm |

Example 5

Fabric Mechanical Properties

After PLA Sea Removal

Figure 27A:
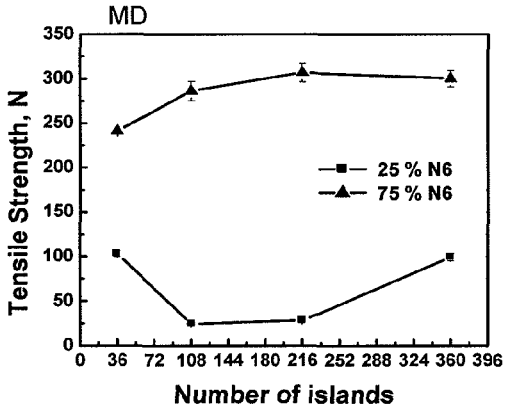
FIG. 27*a* is a chart illustrating machine direction tensile strength of a fabric prepared according to certain embodiments of the invention comprising nylon-6 fibers as islands remaining from a nylon-6/PLA multicomponent fiber that was hydroentangled and subjected to removal of the PLA sea.
Figure 27B:
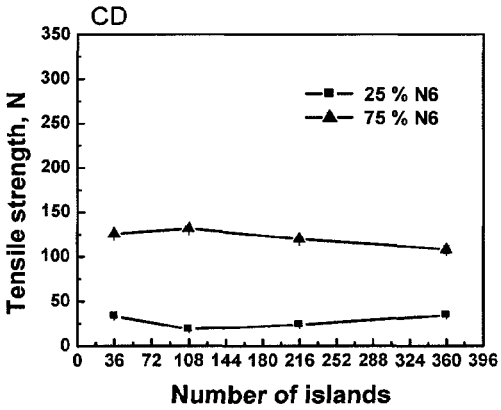
FIG. 27*b* is a chart illustrating cross-machine direction tensile strength of a fabric prepared according to certain embodiments of the invention comprising nylon-6 fibers as islands remaining from a nylon-6/PLA multicomponent fiber that was hydroentangled and subjected to removal of the PLA sea.
Figure 28A:
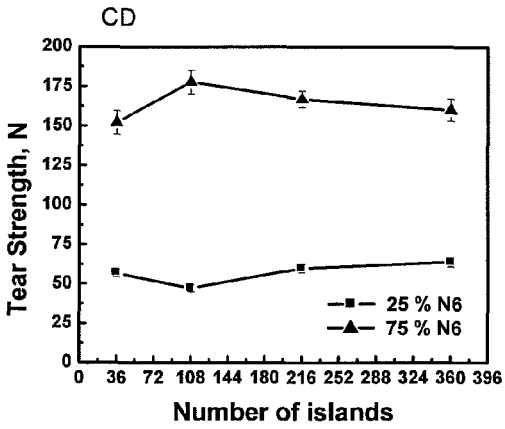
FIG. 28*a* is a chart illustrating cross-machine direction tear strength of a fabric prepared according to certain embodiments of the invention comprising nylon-6 fibers as islands remaining from a nylon-6/PLA multicomponent fiber that was spunbonded and subjected to removal of the PLA sea.
Figure 28B:
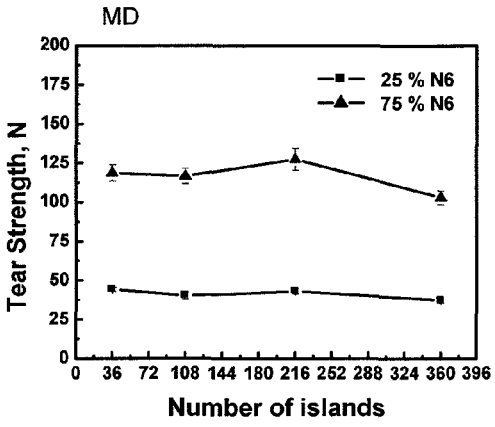
FIG. 28*b* is a chart illustrating machine direction tear strength of a fabric prepared according to certain embodiments of the invention comprising nylon-6 fibers as islands remaining from a nylon-6/PLA multicomponent fiber that was spunbonded and subjected to removal of the PLA sea.

Mechanical properties for the nylon-6 webs prepared according to Example 1 after hydroentangling and removal of the PLA sea are illustrated in FIG. 27*a* through FIG. 28*b*. FIG. 27*a* illustrates MD tensile strength; FIG. 27*b* illustrates CD tensile strength; FIG. 28*a* illustrates CD tear strength; FIG. 28*b* illustrates MD tear strength. Among the samples comprising 75% nylon-6, the fabrics initially comprising 108 and 216 islands showed the best tensile and tear performance in CD and MD, respectively. Nonwovens originally comprising 25% nylon-6 and 36 islands demonstrated the highest tensile and tear properties in MD, whereas the webs comprising 25% nylon-6 and 360 islands had the highest values of the tensile and tear strength in CD. Visual examination of the hydroentangled substrates that exhibited the best performance indicated these webs had the most uniform structure and showed no delaminating during mechanical testing in contrast to other samples examined. This indicates web uniformity and bonding efficiency were prevalent factors influencing the mechanical properties of the hydroentangled nylon-6 webs.

Example 6

Effect of Thermal Bonding Before and after PLA Sea Removal on Fabric Mechanical Properties Fabric mechanical properties were evaluated to compare fabrics prepared according to the present invention without heat bonding with fabrics prepared using heat bonding. Three fabrics were prepared as described in Example 1. The multicomponent fibers were prepared using PLA as the sea component and nylon-6 as the island components. The fiber was extruded to comprise 108 island components with a 50/50 I/S ratio. The fabrics were hydroentangled using three passes. The calendaring device was set for point bonding of the fabric. The results are provided below in Table 5.

TABLE 5

| | MD | | CD | |
|---|---|---|---|---|
| Bonding Conditions | Tensile Strength (N) | Tear Strength (N) | Tensile Strength (N) | Tear Strength (N) |
| Hydroentangling followed by PLA removal | 168.7 | 83.4 | 51.0 | 151.1 |
| Hydroentangling followed by PLA removal and subsequent Calendaring at 145° C. | 178.5 | 49.1 | 52.0 | 104.0 |
| Hydroentangling followed by Calendaring at 190° C. and subsequent PLA removal | 69.7 | 27.5 | 29.4 | 43.2 |

As seen above, thermal bonding after removal of the sea component was useful for increasing tensile strength (particularly MD tensile strength). However, fabrics prepared according to the invention without thermal bonding otherwise outperformed the thermally bonded fabrics. This is particularly seen in the sample where calendaring was carried out before removal of the sea component. The effect of thermal bonding is further illustrated in FIG. 29, which shows the sample calendared after removal of the sea component, and FIG. 30, which shows the sample calendared before removal of the sea component.

Figure 29:
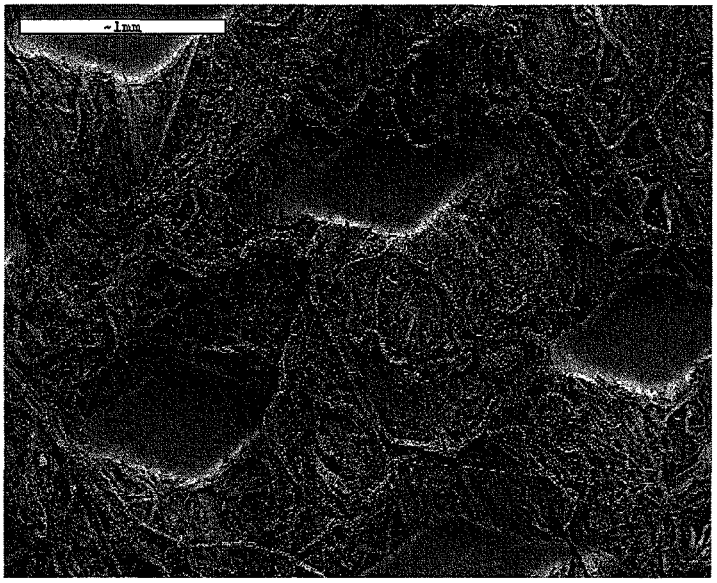
FIG. 29 is an SEM image of a fabric prepared according to one embodiment of the invention using an I/S fiber that was hydroentangled, subjected to removal of the sea component, and calendared.
Figure 30:
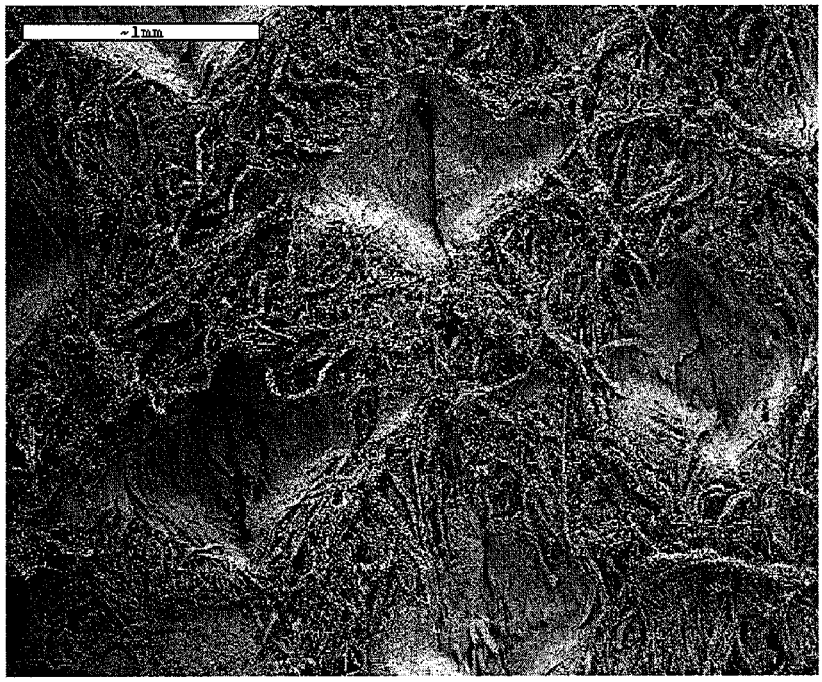
FIG. 30 is an SEM image of a fabric prepared according to one embodiment of the invention using an I/S fiber that was hydroentangled, calendared, and then subjected to removal of the sea component.
Figure 31:
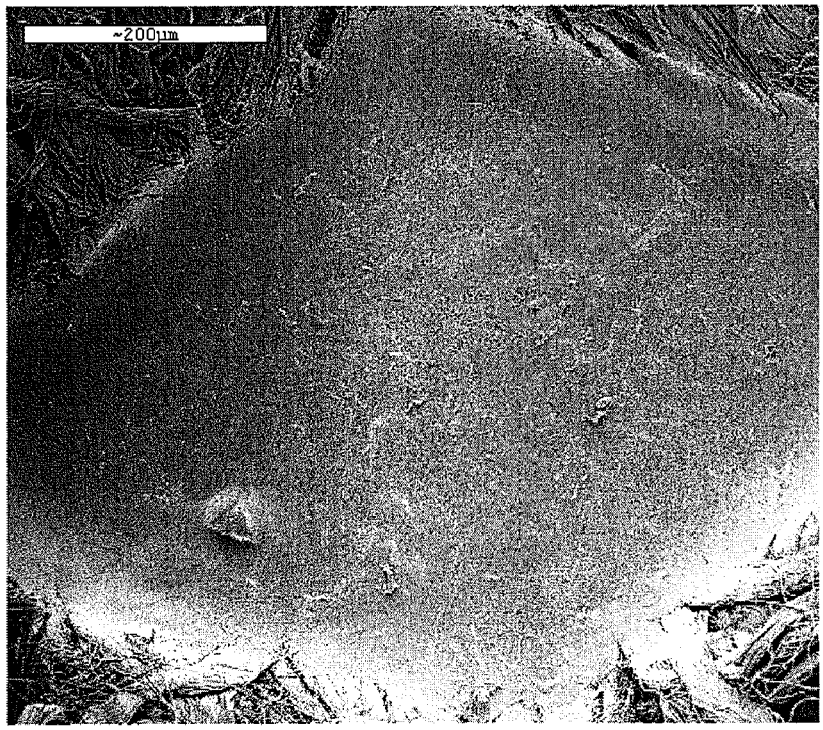
FIG. 31, is a detailed view of one bond point of the fabric illustrated in FIG. 29.
Figure 32:
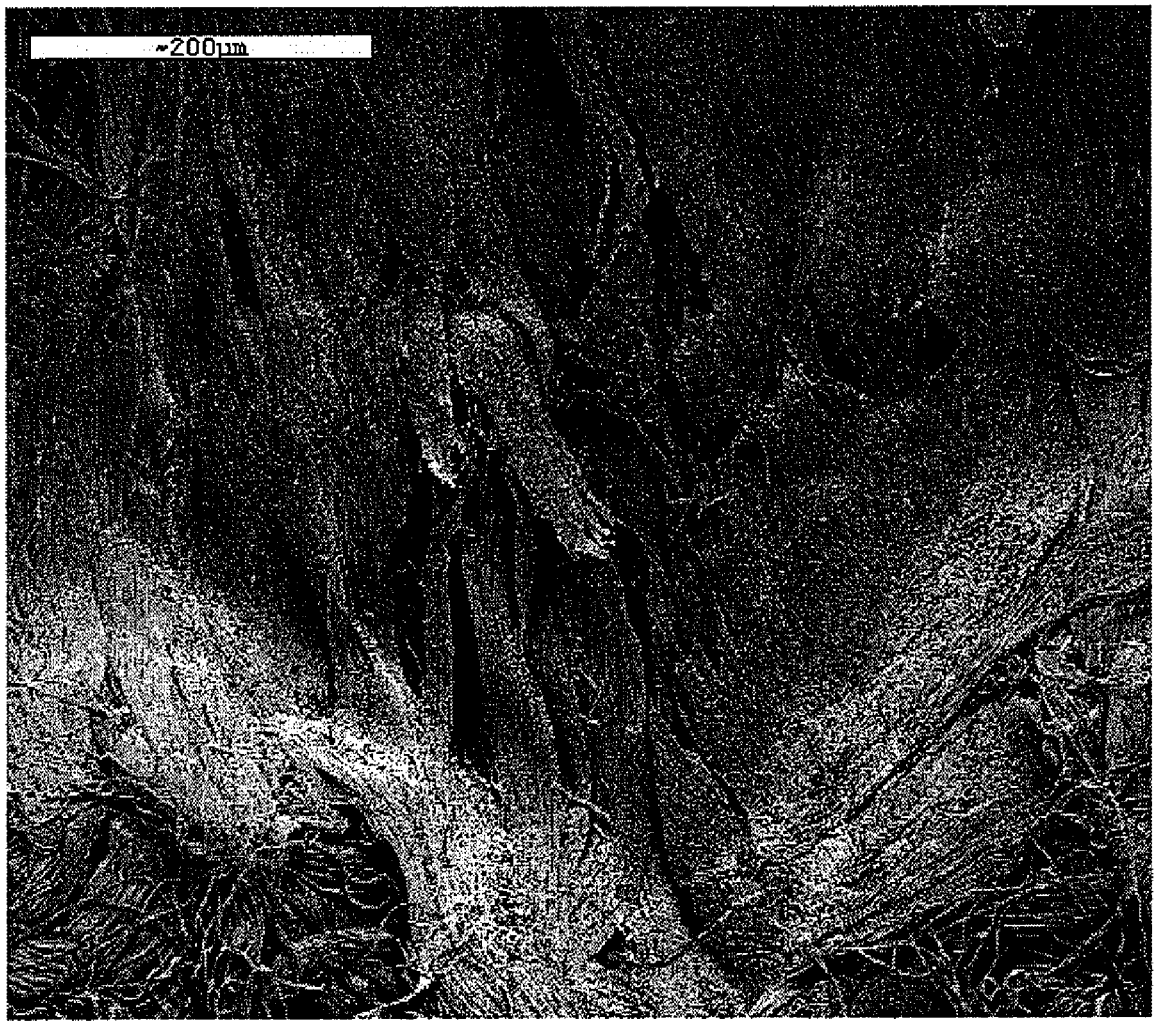
FIG. 32 is a detailed view of one bond point of the fabric illustrated in FIG. 30.

The diamond-shaped thermal bond points in FIG. 29 are clean and distinct, while the bond points in FIG. 30 are more irregular and show marked delamination. This is further illustrated in FIG. 31, which shows a more detailed view of one bond point from FIG. 29. Likewise, FIG. 32 shows a more detailed view of one bond point from FIG. 30. As clearly see in FIG. 32, thermal bonding prior to removal of the sea component can be a detriment to the overall integrity of the fabric, particularly at the bond points.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of preparing a nonwoven spunbonded fabric comprising:

extruding multicomponent fibers having a predetermined average diameter and having an islands in the sea configuration comprising a plurality of island components comprising a first polymer surrounded by a sea component comprising a second polymer;

forming a spunbonded web comprising the extruded multicomponent fibers; and mechanically entangling the multicomponent fibers to form a nonwoven spunbonded fabric devoid of thermal bonds.

2. The method of claim 1, further comprising thermally bonding the entangled fibers.

3. The method of claim 1, further comprising removing the sea component after the step of mechanically entangling the multicomponent fibers.

4. The method of claim 3, further comprising thermally bonding at least a portion of the island components after removal of the sea component.

5. The method of claim 1, wherein the multicomponent fibers comprise an outer surface, and wherein the sea component completely surrounds the island components such that none of the island components form any portion of the outer surface of the multicomponent fibers.

6. The method of claim 5, wherein the sea component completely surrounds the island components such that the sea component forms a sheath around the island components, the sheath having a thickness measured between the outer surface of the multicomponent fiber and the islands nearest the outer surface of the multicomponent fiber.

7. The method of claim 6, wherein the sheath has a thickness that is greater than or equal to an average diameter of the island components.

8. The method of claim 1, wherein said extrusion step comprises forming a multicomponent fiber having an average diameter in the range of about 5 μm to about 25 μm.

9. The method of claim 1, wherein said extrusion step comprises forming a multicomponent fiber having an average diameter in the range of about 10 μm to about 20 μm.

10. The method of claim 1, wherein said extrusion step comprises forming a multicomponent fiber comprising island components having an average diameter in the range of about 50 nm to about 5 μm.

11. The method of claim 10, wherein the island components have an average diameter in the range of about 50 nm to about 1 μm.

12. The method of claim 10, wherein the island components have an average diameter in the range of about 100 nm to about 800 nm.

13. The method of claim 1, wherein said extrusion step comprising forming a multicomponent fiber comprising between about 2 and about 1000 island components.

14. The method of claim 1, wherein said extrusion step comprising forming a multicomponent fiber comprising between about 36 and about 400 island components.

15. The method of claim 1, wherein said extrusion step comprises forming a multicomponent fiber comprising an island/sea ratio in the range of about 75/25 to about 25/75.

16. The method of claim 1, wherein the first polymer is different from the second polymer.

17. The method of claim 1, wherein the first polymer comprises a polymer that normally exhibits a static charge during extrusion, and wherein the multicomponent fiber is extruded in the absence of any anti-static components.

18. The method of claim 17, wherein the first polymer comprises a polyamide.

19. The method of claim 1, wherein the first polymer comprises a polymer selected from the group consisting of polyolefins, polyamides, polyesters, thermoplastics, and combinations thereof.

20. The method of claim 1, wherein the second polymer comprises a polymer capable of being dispersed or dissolved in an aqueous solution.

21. The method of claim 20, wherein the second polymer comprises a polymer selected from the group consisting of polyvinyl alcohol, poly(lactic) acid, co-PET, and combinations thereof.

22. The method of claim 1, wherein the first polymer comprises nylon and the second polymer comprises PLA.

23. The method of claim 1, wherein said step of mechanically entangling the multicomponent fibers comprises a method selected from the group consisting of hydroentangling, needle punching, steam jet entangling, and combinations thereof.

24. The method of claim 1, wherein the spunbonded web comprises a first surface and an opposing surface, and wherein said mechanically entangling step is carried out on only one of the surfaces.

25. The method of claim 1, wherein the spunbonded web comprises a first surface and an opposing surface, and wherein said mechanically entangling step is carried out on the first surface and the opposing surface.

* * * * *